US005652940A

United States Patent [19]

Saito

[11] Patent Number: 5,652,940

[45] Date of Patent: Jul. 29, 1997

[54] SOLID PROCESSING AGENT SUPPLYING DEVICE FOR SILVER HALIDE PHOTOGRAPHIC MATERIAL

[75] Inventor: Kaneo Saito, Hino, Japan

[73] Assignee: Konica Corporation, Tokyo, Japan

[21] Appl. No.: 565,780

[22] Filed: Dec. 1, 1995

[30] Foreign Application Priority Data

Dec. 9, 1994 [JP] Japan ..... 6-306353
May 24, 1995 [JP] Japan ..... 7-125235

[51] Int. Cl.[6] ..... G03D 3/02

[52] U.S. Cl. ..... 396/620

[58] Field of Search ..... 354/324; 221/197; 396/626; 430/450, 465, 398–400

[56] References Cited

U.S. PATENT DOCUMENTS 5,508,777 4/1996 Isokawa et al. ..... 396/626

*Primary Examiner*—D. Rutledge

*Attorney, Agent, or Firm*—Frishauf, Holtz, Goodman, Langer & Chick

[57] ABSTRACT

A silver halide photographic material processing apparatus is provided with a solid processing agent replenishing unit which includes a supplying device for supplying a solid processing agent to the tank; and a constructing member for forming a guide passage in the tank in such an arrangement that the guide passage receives the solid processing agent from the supplying device, guides the solid processing agent to an upper portion above a filter, and feed the solid processing agent from the upper portion into the processing solution.

16 Claims, 20 Drawing Sheets

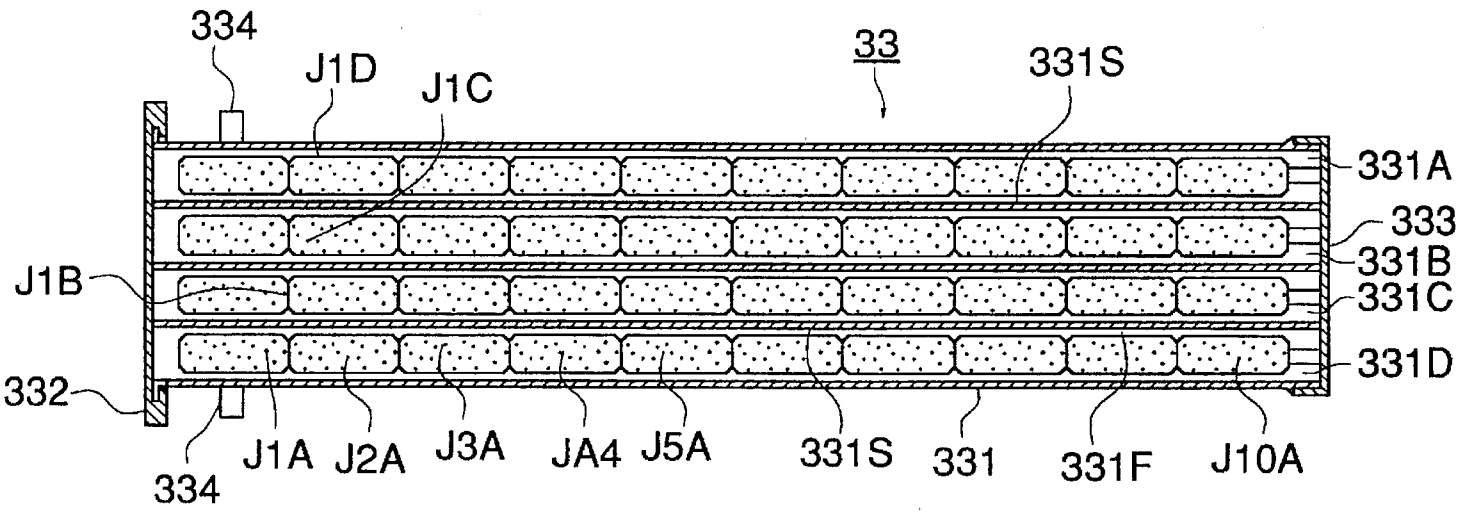
FIG. 6 ( A )
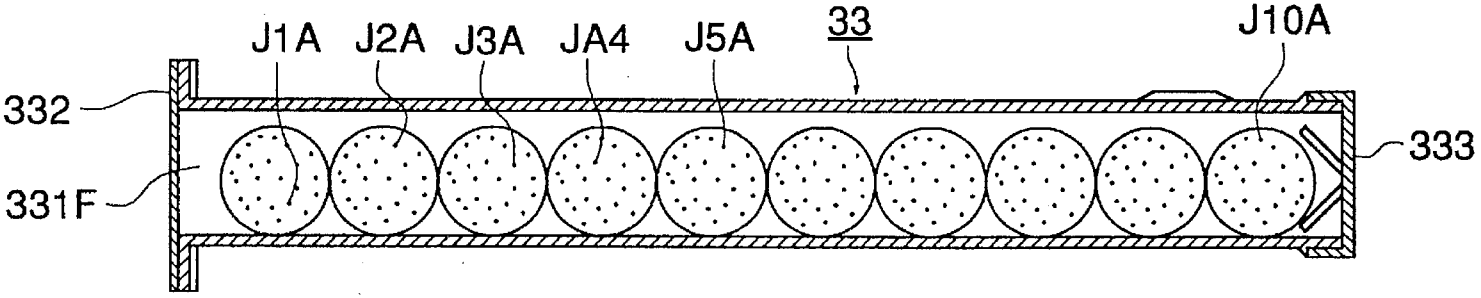
FIG. 6 ( B )

FIG. 10 ( A )
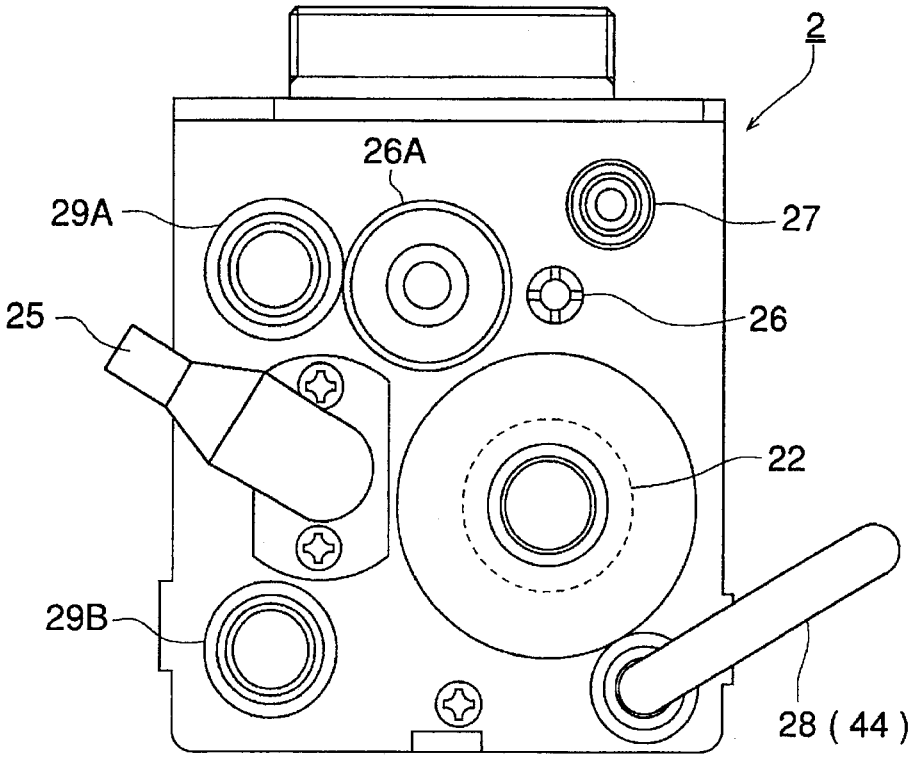
FIG. 10 ( B )
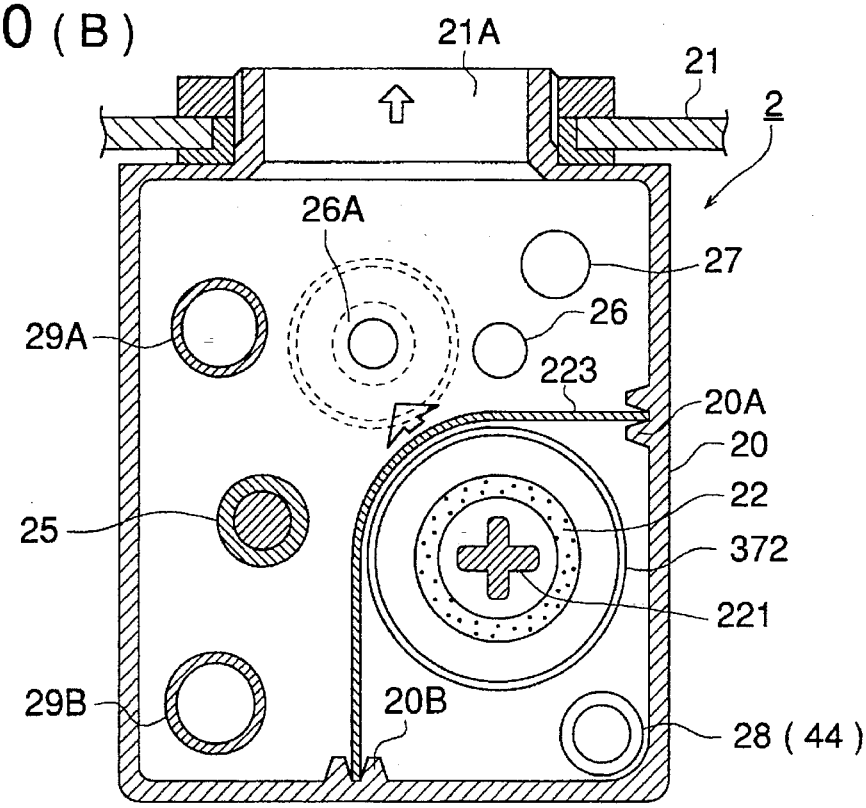

FIG. 13 ( A )
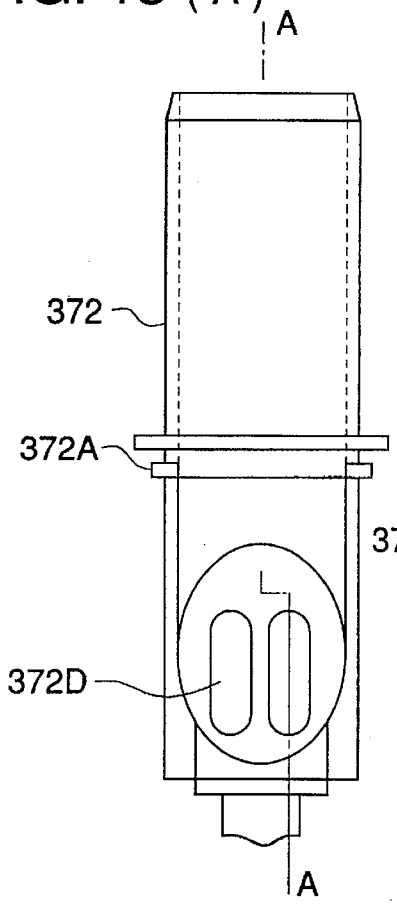
FIG. 13 ( B )
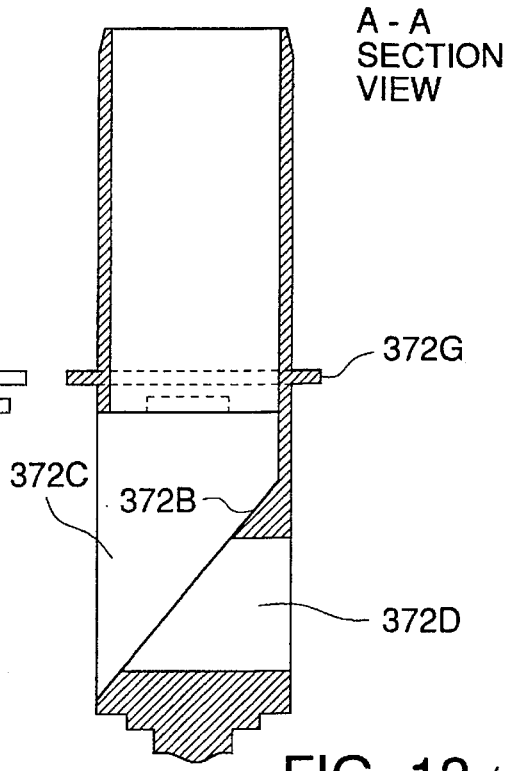
FIG. 13 ( C )
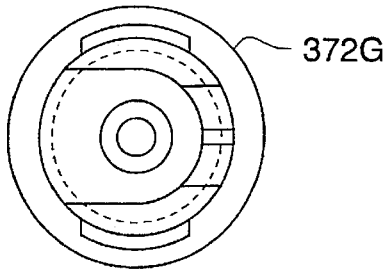
FIG. 13 ( D )
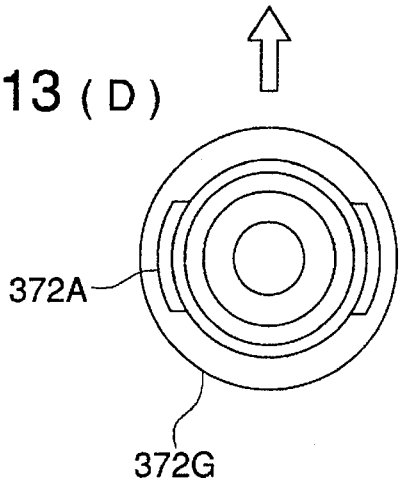
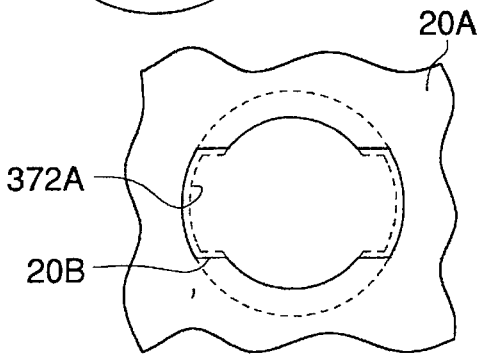
FIG. 13 ( E )

FIG. 15 ( A )
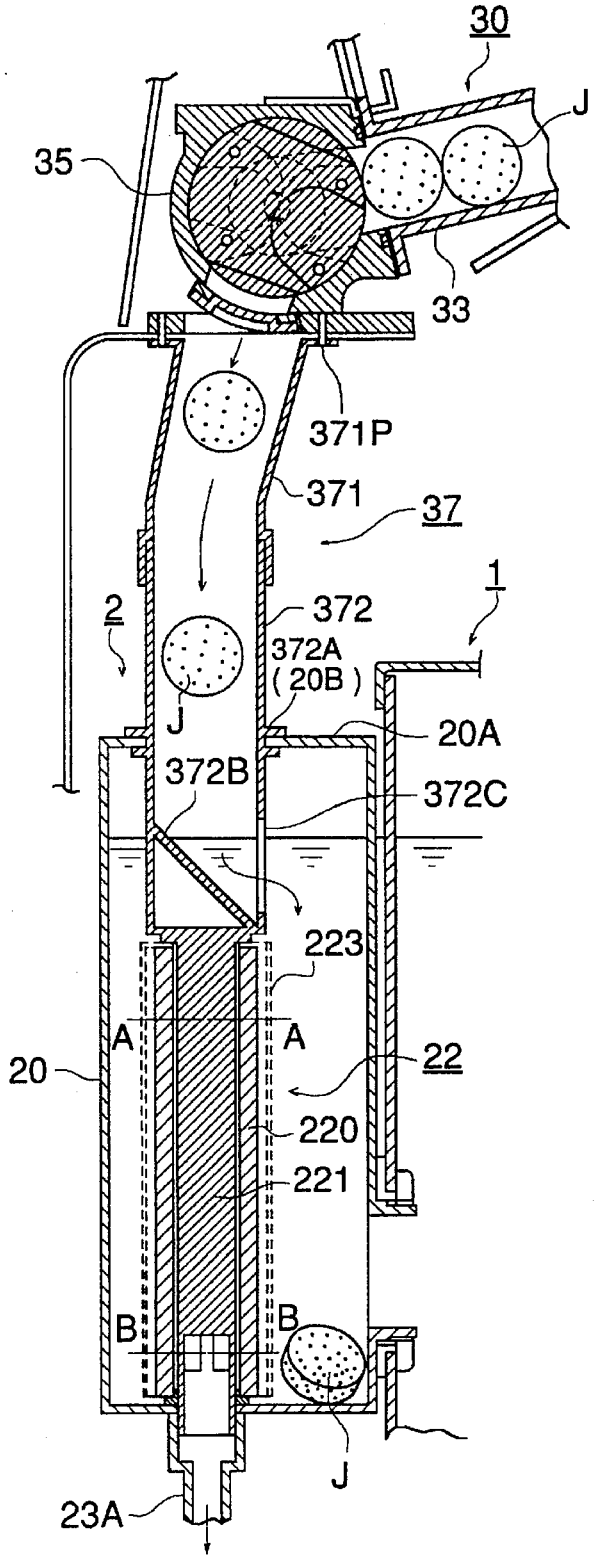
FIG. 15 ( B )
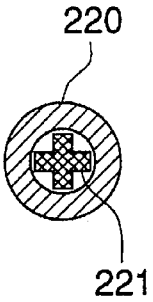
FIG. 15 ( C )
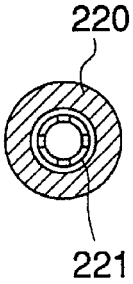

SOLID PROCESSING AGENT SUPPLYING DEVICE FOR SILVER HALIDE PHOTOGRAPHIC MATERIAL

BACKGROUND OF THE INVENTION

The present invention relates to a solid processing agent supplying device for a silver halide photographic material, to a unit to modify an installed automatic processing apparatus using a liquid processing agent so as to use a solid processing agent, and to an automatic processing apparatus on which the supplying device and the unit are mounted. More concretely, the present invention relates to a solid processing agent supplying device for silver halide photographic material with which the conventional automatic processing apparatus not being provided with a solid processing agent supplying device is modified so as to allow the solid processing agent supplying device to be mounted thereon with the smallest modification, to a unit to modify the installed automatic processing apparatus using the liquid processing agent so as to use a solid processing agent, and to an automatic processing apparatus on which the supplying device and the unit are mounted.

After exposure, a silver halide photographic material is subjected to processing with processing solutions, such as a developing solution (or a color developing solution as required), a bleaching solution, a fixing solution, a bleach fixing solution and a stabilizing solution. The processes are usually conducted in an automatic processing apparatus. In this case, a method of replenishing a replenishing solution is ordinarily adopted so that each processing solution in its respective processing tank is controlled so as to keep its chemical activity.

In the case of the method of replenishing the replenishing solution, the objective is to dilute the accumulation of the dissolving-out materials from the photographic material in the,processing solution, to compensate for an evaporation and to replenish consumed components. Due to the solubility of the photographic components in the replenishing solution, usually, a large amount of overflow solution is discharged.

In order to conduct the processing of photographic material on a commercial basis, it is required to reduce cost and labor work, to reduce pollution, to make the processing apparatus as compact as possible. Also, in order to enhance the commercial value, it may be required as far as possible to obtain a stable and superior processing capability with a small amount of the processing solution.

As a method to respond to these demands, Japanese Patent Application Open to Public Inspection No. 5-119454 discloses a method of making almost all of the processing agent components in the form of solid processing agents and of supplying these directly into the processing tank.

The above method is a very effective method in attaining the above objective. However, the method is not applicable to a solution-replenishing type automatic processing apparatus a great number of which are in commercial use. In order to obtain the above benefits, it is often necessary to purchase a new automatic processing apparatus for solid processing agents.

To counter the above problems, Japanese Patent Application No. 5-304298 discloses a construction in which a solid processing agent is dissolved in a dissolving tank provided separately from an automatic processing apparatus. However, it has been found that the construction has various drawbacks. For example, since the dissolving tank is provided separately from the automatic processing apparatus, a additional floor space for the dissolving tank is needed in the vicinity of the automatic processing apparatus. Accordingly, such required space raises problems for the so-called "Mini-Labo" with limited floor space. Further, since it is necessary to circulate the processing solution through pipes between the dissolving tank and the automatic processing apparatus, an additional great amount of processing solution is needed. Further, since the dissolving tank containing a great amount of processing solution is distant from the automatic processing tank which is warmed up with heat sources such as a pump, a heater and a dryer, the temperature of the dissolving tank is lowered during a pause in processing in winter time. Accordingly, it has been found that a trouble that photographic chemicals may deposit on the pipe line and the dissolving tank may take place easily. Still further, in order to circulate the tank solution in the dissolving tank, equipment including at least a circulating pump, a filter and a pipe is needed. As a result, it has been found that there is a defect that a great amount of cost is required for the equipment.

SUMMARY OF THE INVENTION

A first objective of the present invention is to make it possible to adopt a new type solid processing agent replenishing apparatus onto a conventional processing solution type automatic processing apparatus without major modifications.

A second objective is to make it possible to replenish solid processing agent without requiring an additional installing space and without increasing the amount of processing solution in the processing tank.

A third objective is to provide a solid processing agent supplying apparatus for a silver halide photographic material, a unit to modify an installed automatic processing apparatus using a liquid processing agent so as to use a solid processing agent, and an automatic processing apparatus on which the supplying device and the unit are mounted, wherein the cost of equipment to make it possible to replenish a solid processing agent is slight and problems such as deposition of chemicals does not take place.

A fourth objective is to make it possible with a modification of the present invention to easily introduce a new type automatic processing apparatus with which stable replenishment and photographic processing capability are obtained by a simple operation and waste solution is greatly reduced.

A fifth objective is to make it possible to mount or dismount a filter means provided in a processing tank and a member forming a solid processing agent dropping passage (or a constructing member for forming a guide passage in the tank).

A sixth objective is to make it possible to additionally mount a solid processing agent replenishing apparatus on an installed conventional automatic processing apparatus in an original installed location with minor modifications.

In a solid processing agent replenishing apparatus for replenishing a solid processing agent to a processing solution section of an automatic processing apparatus for a silver halide photographic material, the above objects are attained by the solid processing agent replenishing apparatus characterized by comprising at least (1) a solid processing agent accommodation container for accommodating the solid processing agent;(2) a supplying device for supplying the solid processing agent in the solid processing agent accommodation container; and (3) a passage-constructing member for supplying the solid processing agent supplied from the supplying device through an upper portion of the filter-replacing section in a processing solution tank of the automatic processing apparatus.

Further, the above objective is attained by a unit to modify a replenishing solution type automatic processing apparatus into an automatic processing apparatus capable of being replenished with a solid processing agent, the unit is characterized by comprising at least (1) a solid processing agent accommodation container for accommodating the solid processing agent; (2) a supplying device for supplying the solid processing agent in the solid processing agent accommodation container; and (3) a passage-constructing member for supplying the solid processing agent supplied from the supplying device through an upper portion of the filter-replacing section in a processing solution tank of the automatic processing apparatus.

Further, in an automatic processing apparatus which is modified from a replenishing solution type automatic processing apparatus into a silver halide photographic material equipped with a solid processing agent replenishing apparatus for replenishing a solid processing agent to a processing solution section, the above objective are attained by the solid processing agent replenishing apparatus characterized by comprising at least (1) a solid processing agent accommodation container for an automatic processing apparatus for accommodating the solid processing agent; (2) a supplying device for supplying the solid processing agent in the solid processing agent accommodation container; and (3) a passage-constructing member for supplying the solid processing agent supplied from the supplying device through an upper portion of the filter-replacing section in a processing solution tank of the automatic processing apparatus.

Further, in an automatic processing apparatus equipped with a solid processing agent replenishing apparatus for replenishing a solid processing agent to a processing solution section of an automatic processing apparatus for a silver halide photographic material, the above objective are attained by a filter-fixing member for use in the automatic processing apparatus characterized in that a guiding means forming a passage to drop a solid processing agent discharged from the solid processing agent replenishing apparatus to a processing solution section is integrally provided on an upper portion of a fixing shaft which holds and fixes a filter member provided detachably the processing solution section.

Further, in an automatic processing apparatus equipped with a solid processing agent replenishing apparatus for replenishing a solid processing agent to a processing solution section of an automatic processing apparatus for a silver halide photographic material, the above objective are attained by a filter-fixing member for use in the automatic processing apparatus characterized in that a fixing shaft which holds and fixes a filter member provided detachably in the processing solution section is separable from the passage to drop a solid processing agent discharged from the solid processing agent replenishing apparatus to a processing solution section and is able to secure the filter member in the processing tank.

BRIEF DESCRIPTION OF THE DRAWINGS

FIGS. 6(A) and 6(B) are sectional views of a solid processing agent accommodation container.

FIG. 10(A) is a plan view showing a dissolving tank and FIG. 10(B) is a sectional view of said tank.

FIG. 13(A) is a front view of a connecting cylinder, FIG. 13(B) is a sectional view at A—A section of the connecting cylinder; FIG. 13(C) to 13(E) are sectional plan views.

FIG. 15 (A) is a sectional view showing a solid processing agent replenishing apparatus, a guiding means and a filter, FIGS. 15(B) and 15(C) are sectional plan views thereof.

DETAILED DESCRIPTION OF THE PREFERRED EMBODIMENT

Figure 1:
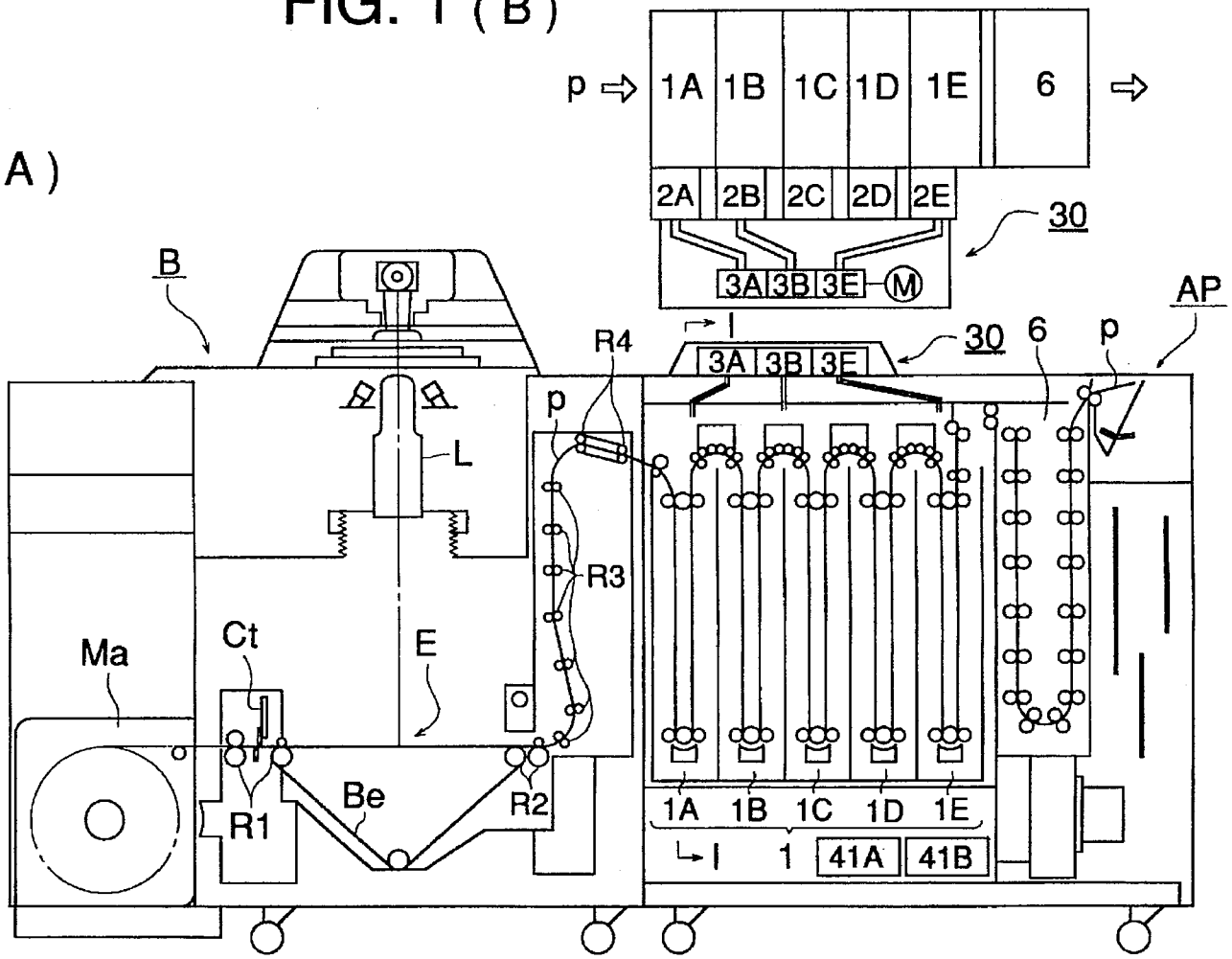
FIG. 1(A) is an over-all structural view of a silver halide photographic material processing apparatus AP as seen from the front side.
FIG. 1(B) is a plan view of the silver halide photographic material processing apparatus AP.

Next, one example of the present invention will be explained on the basis of the attached drawing. However, the present invention is not limited to this example.

One example of an automatic processing apparatus of the present invention is explained on the basis of the accompanying drawings. FIG. 1(A) is an entire structural view of a silver halide photographic material processing apparatus (a printer processor) on its front side in which the automatic processing apparatus AP for developing printing paper and a photographic printer B are integrally constructed into one unit.

In FIG. 1(A), to the lower left portion of the photographic printer B, a magazine Ma in which printing paper (color paper) which is an unexposed silver halide photographic material is stored in the form of a roll is set. The printing paper p drawn out from the magazine Ma is cut into predetermined sizes with a feeding roller R1 and a cutter section Ct, thereby obtaining a sheet-formed printing paper p. The sheet-formed printing paper is conveyed by a belt type conveying means Be, and is exposed with an original image by a light source and a lens L in an exposure section E. The thus exposed sheet-formed printing paper p is further conveyed by plural pairs of feeding rollers R2, R3, R4 and is introduced into the automatic processing apparatus AP. In the automatic processing apparatus, the sheet-formed printing paper p is conveyed sequentially into processing tanks such as a color developing tank 1A, a bleach fixing tank 1B, a stabilizing tank 1C, 1D, 1E by a roller type conveying means (no reference number) so that the sheet-formed printing paper is subjected to a color developing process, a bleach fixing process and a stabilizing process. The processing tank is actually a processing tank composed of three tanks. After the sheet-formed printing paper is subjected to each process, the sheet-formed printing paper is dried in a drying section 6, and then discharged outside the apparatus.

In this example, the printing paper p is introduced into the automatic processing apparatus AP in the form of a cut sheet. However, the printing paper p may be introduced in the form of a web.

Further, the automatic processing apparatus AP may be integrated with the photographic printer B into one unit. However, needless to explain, the automatic processing apparatus AP may also be constructed independently in a single body.

Still further, the automatic processing apparatus AP comprising the substantial three tank construction of the color developing tank 1A, the bleach fixing tank 1B, and the stabilizing tanks 1C, 1D, 1E is explained as one example of the present invention. The present invention is not limited to this example. For example, the present invention may be applied to an automatic processing apparatus actually comprising four or more tanks, such As a color developing tank, a bleaching tank, a fixing tank and a stabilizing tank which are used for processing exposed negative film.

FIG. 1(B) is a plan view showing construction of the automatic processing apparatus AP. Auxiliary tanks (a dissolving tank, a constant temperature tank) 2A, 2B, 2C, 2D, 2E communicate with the respective tank of the color developing tank 1A, the bleach fixing tank 1B and the stabilizing tank 1E. A solid processing agent supply apparatus 30 including solid processing agent supply devices 3A, 3B and 3E for supplying a solid agent is mounted on an upper portion of the casing of the automatic processing apparatus AP. Reference No. 41A is a water supply tank from which water is supplied to the color developing tank 1A. The water supply tank was originally used as a color developing process supply tank. Reference No. 41B is a water supply tank from which water is supplied to the bleach fixing tank 1B and the stabilizing tank 1E. The water supply tank 41B was originally used as a stabilizing process supply tank.

Figure 2:
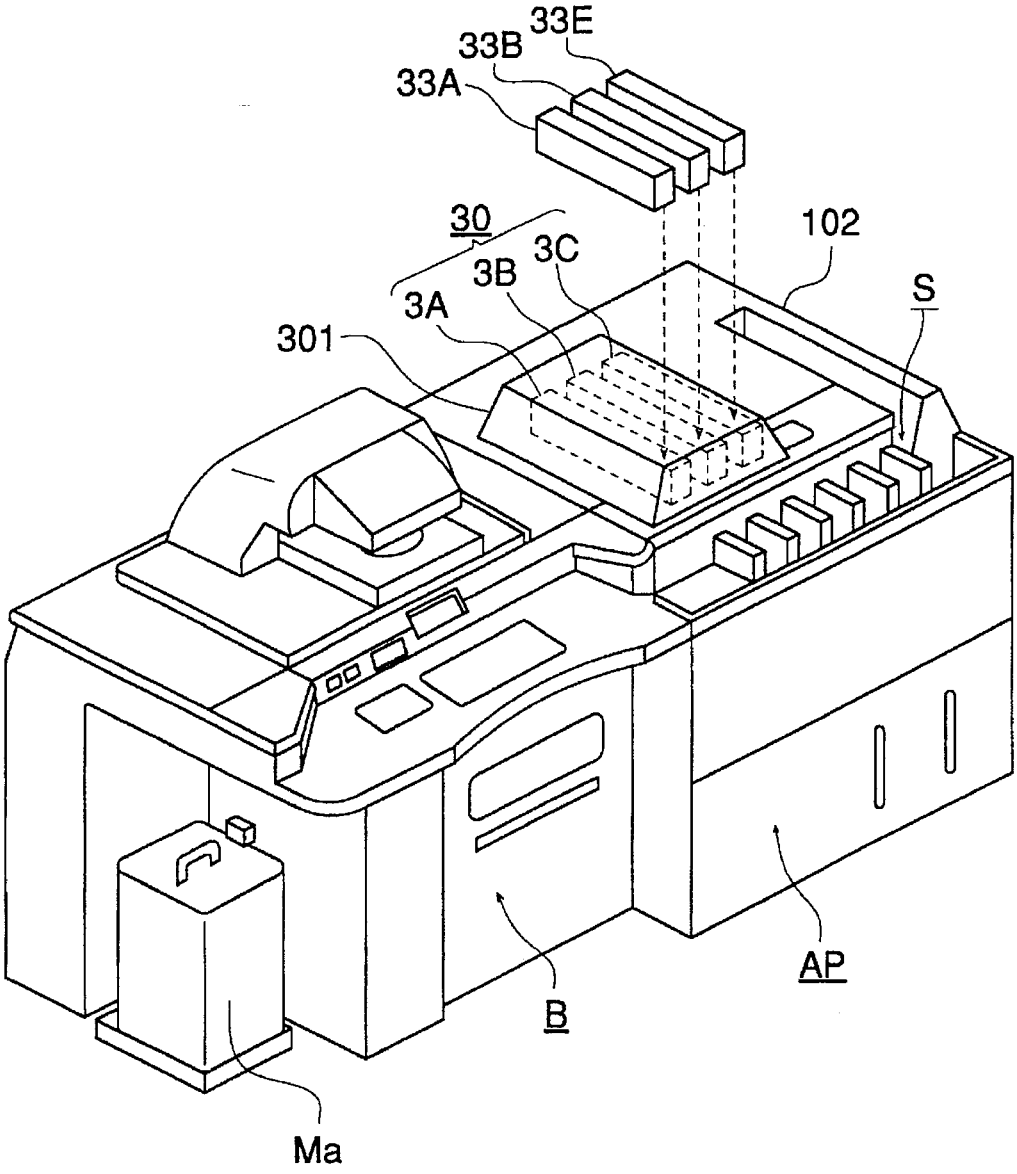
FIG. 2 is a perspective view of the silver halide photographic material processing apparatus AP.

FIG. 2 is a perspective view showing general construction of the printer processor of the present invention in which the automatic processing apparatus AP, a photographic printer B and a soater S are integrated in the form of one body. In FIG. 2, a cover 301 of the solid agent supply apparatus is opened upward, each of accommodating containers 33A, 33B, 33E storing a belowmentioned solid agent J are set respectively at a predetermined position on a belowmentioned supplying apparatus 34, and the solid agent J in the accommodating containers 33A, 33B, 33E is supplied into each dissolving tank (auxiliary tank) 2A, 2B, 2E.

Figure 3:
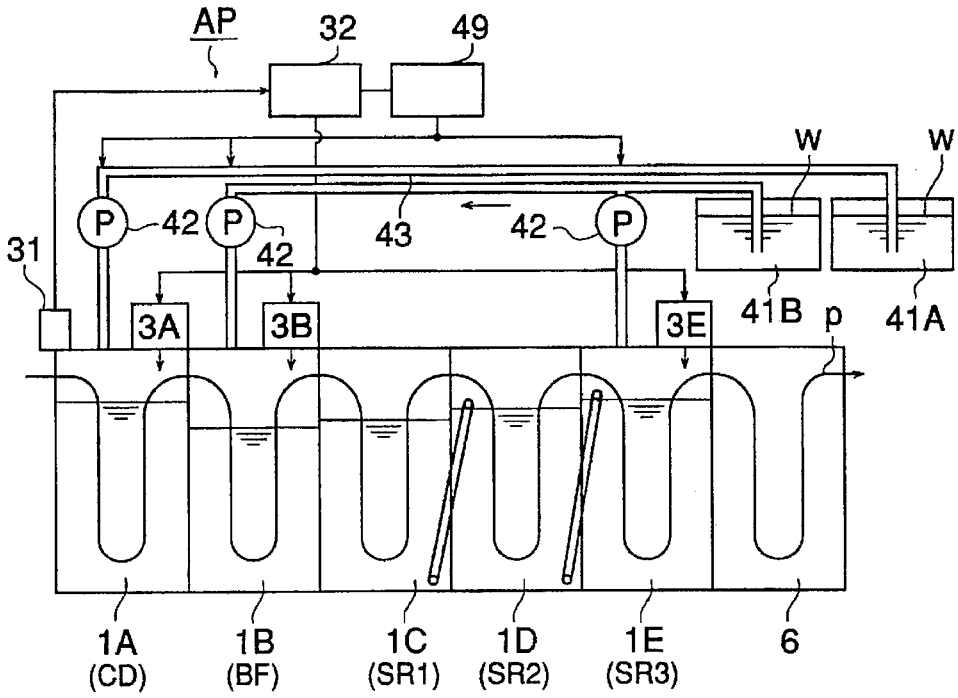
FIGS. 3(A) and 3(B) are sectional views showing construction of the silver halide photographic material processing apparatus AP.
Figure 3:
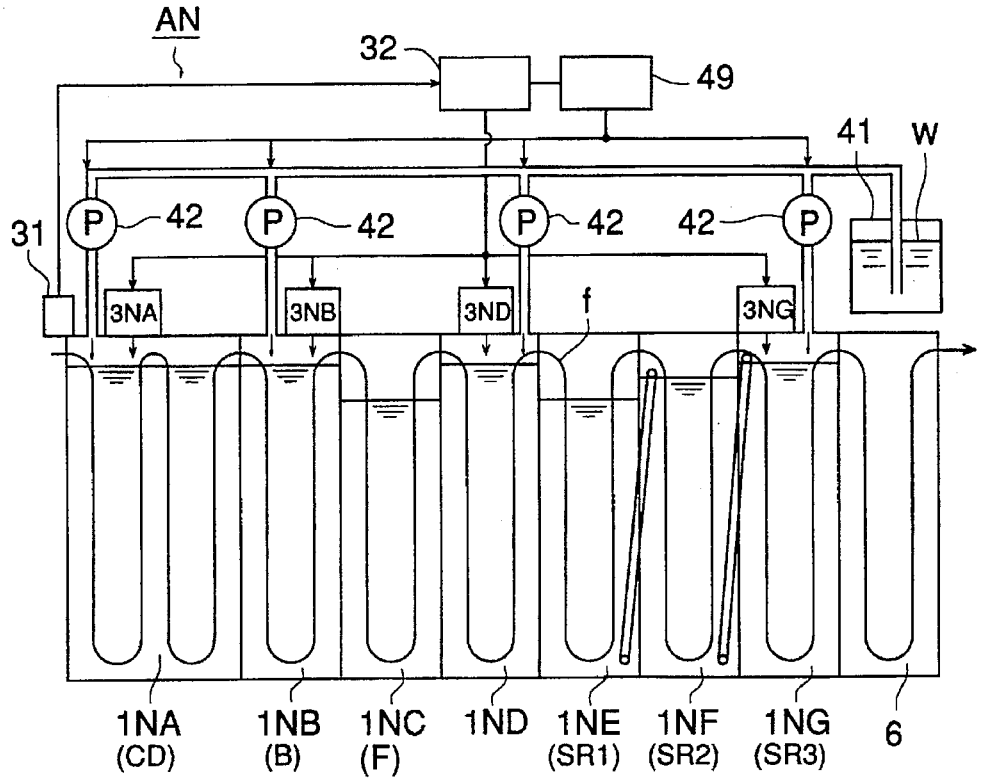

FIG. 3(A) is a schematic view showing an outline of the construction of the automatic processing apparatus AP for developing a sheet-formed printing paper p. In the automatic processing apparatus AP, the sheet-formed printing paper is processed with each processing solution (CD, BF, SR1, SR2 and SR3) in the corresponding tank of the color developing tank 1A, the bleach fixing tank 1B and the stabilizing tanks 1C, 1D, 1E, thereafter the sheet-formed printing paper is dried in the drying section 6. The solution level in each stabilizing tanks 1C, 1D, 1E is higher in such the order than the solution level in the bleach fixing tank 1B. Accordingly, the solution levels are arranged to form the construction according to so-called counter-current method in which overflow solution from the tank 1E flows by its gravity into 1D, 1C, and into 1B in the order. Reference Nos. 3A, 3B, 3E are solid processing agent supply devices, 31 is a throughput amount detection means, 32 is a solid processing agent supply control means, 41A, 41B are water supply tanks, 42 is a feed water pump, 43 is a feed water pipe, 49 is a water supply control means.

FIG. 3(B) is a view showing an outline of the construction of an automatic processing apparatus AN for developing a negative film. In the automatic processing apparatus AN, the negative film is processed with each processing solution (CD, BF, SR1, SR2 and SR3) in the corresponding tank of the color developing tank 1NA, the bleaching tank 1NB, the fixing tank 1NC, 1ND and the stabilizing tanks 1NE, 1NF, 1NG, thereafter the negative film is dried in the drying section 6. Each of the color developing tank 1NA, the bleaching tank 1NB, the fixing tank 1ND and the stabilizing tanks 1NG is provided with one of solid processing agent supply devices 3NA, 3NB, 3ND, 3NG for supplying a solid agent. Incidentally, each portion which has the same function of the corresponding portion in the automatic processing apparatus AP is provided with the same reference No. of the corresponding portion in FIG. 3(A).

Figure 4:
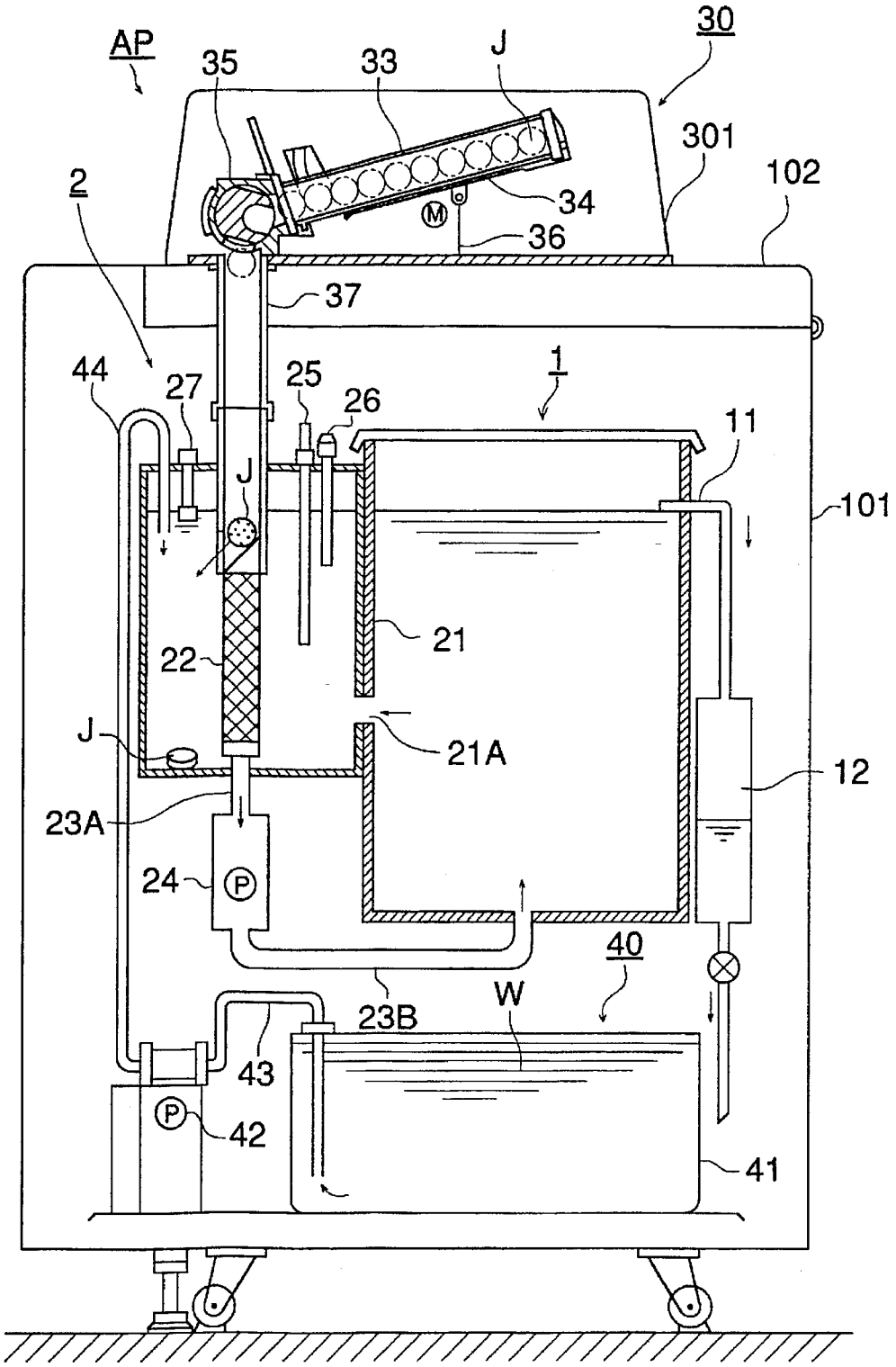
FIG. 4 is a sectional view of the silver halide photographic material processing apparatus AP.

FIG. 4 is a sectional view showing the color developing tank 1A, the auxiliary tank (dissolving tank) 2A and the solid processing agent supply device 3A which is located along I—I section of the automatic processing apparatus AP as indicated in FIG. 1. The bleach fixing tank 1B and the stabilizing tank 1E have substantially the same construction as the color developing tank 1A, hereinafter, an explanation is made for the color developing tank 1A as one example representing all other tanks.

In FIG. 4, to make the construction clear, a conveying means for conveying photographic material is omitted. Further, in this embodiment, an explanation is made for the use of a tablet type solid processing agent J as the solid processing agent. However, a granular solid processing agent is also applicable for this embodiment.

The processing tank 1 in which photographic material P is processed comprises an auxiliary tank 2 (dissolving tank) which is integrally provided outside partition wall 21 forming the processing tank 1. The processing tank 1 and the auxiliary tank 2 are separated from each other by the partition wall 21 in which a communication hole is formed. The processing solution flows through the communication hole between the processing tank 1 and the auxiliary tank 2. A filter means 22, a heater 25, a temperature sensor 26, and a level sensor 27 are provided in the auxiliary tank 2. The inside of the filter means 22 is communicated with the suction end of a circulating pump 24 through a circulating pipe 23*a* provided so as to pass through a lower portion of the wall of the auxiliary tank 2. One end of a circulating pipe 23B is communicated with the delivery side of the circulating pump 24, the circulating pipe passes through an external wall of the processing tank 1 and the other end of the circulating pipe 23B is communicated with the processing tank 1. With this structure, when the circulating pump 24 is operated, the processing solution is sucked from the auxiliary tank 2 and discharged into the processing tank 1 so that the discharged processing solution is mixed with already the processing solution in the processing tank 1, the mixed processing solution flows back to the auxiliary tank 2, and circulation is repeated in such a manner. Reference No. 11 is an overflow pipe, and 12 is a waste solution tank.

In the present invention, as a solid processing agent, a tablet type, granular, powdered, or pill-shaped agent may be used. In particular, the tablet type agent is preferably used.

In the present invention, it is preferable to arrange the filter section beneath the surface of the processing solution. This is because, if a part of the filter protrudes from the surface of the processing solution, the filter section may suck air, thereby causing a trouble that the processing solution may be oxidized.

A water supply means 40 for supplying replenishment water W is composed of a replenishment water tank 41, a bellows pump 42, and feed water pipes 43, 44. An appropriate amount of the replenishment water is supplied at proper times by a water supply control means 49 (see FIG. 3).

The solid processing agent replenishing apparatus 30 is composed of a throughput amount information detecting means 31, a solid processing agent supply controlling means 32 (see FIG. 3), an accommodation container for storing a tablet type solid processing agent J, an accommodation container mounting means 34, a supplying means 35 and a driving means 36. The driving means 36 comprises a single driving source M (a motor). A cover 301, explained below, is pivotably hinged on a part of the upper surface of the upper cover 102 of the automatic processing apparatus AP. The mounting or the replacement of the accommodation container is conducted by opening the cover 301, whereby the tablet type solid processing agent is supplied from the accommodation container.

Figure 5:
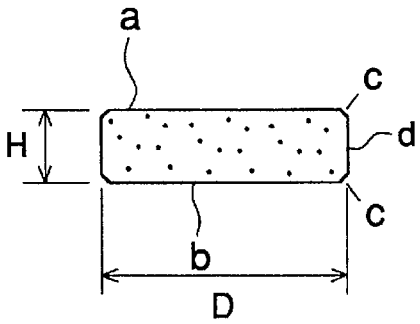
FIGS. 5(A) through 5(G) show various configurations of the tablet type solid processing agent J.
Figure 5:
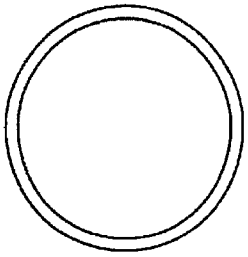
Figure 5:
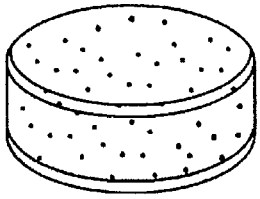
Figure 5:
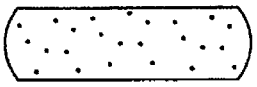
Figure 5:
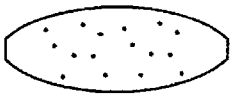
Figure 5:
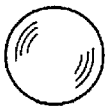
Figure 5:
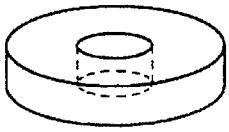

FIG. 5 shows various configurations of the tablet type solid processing agent J which is directly supplied into a processing tank of the automatic processing apparatus. FIG. 5(A) is a sectional view of a flat cylindrical tablet type solid processing agent J consisting of a cylinder surface portion d ahd flat surface portions a, b which are parallel to each other in a direction perpendicular to the center axis of the cylinder surface portion, wherein the flat cylindrical tablet has chamfered corners and has a diameter of D and the thickness H. FIG. 5(B) is a plan view of the solid processing agent J. FIG. 5(C) is a perspective view of the solid processing agent J, and FIG. 5(D) is a sectional view of the barrel-shaped solid processing agent J, wherein the overall configuration is a disc, the upper and lower surfaces are flat, and the circumferential surface is a convex radius of curvature R. FIG. 5(E) is a sectional view of the "go" stone-shaped solid processing agent J, wherein the configuration is flat, and the upper and lower surfaces are formed spherical. FIG. 5(F) is a sectional view of a spherical solid processing agent J, and FIG. 5(G) is a perspective view of the a doughnut-shaped solid processing agent J having a hole at its center.

Figure 7:
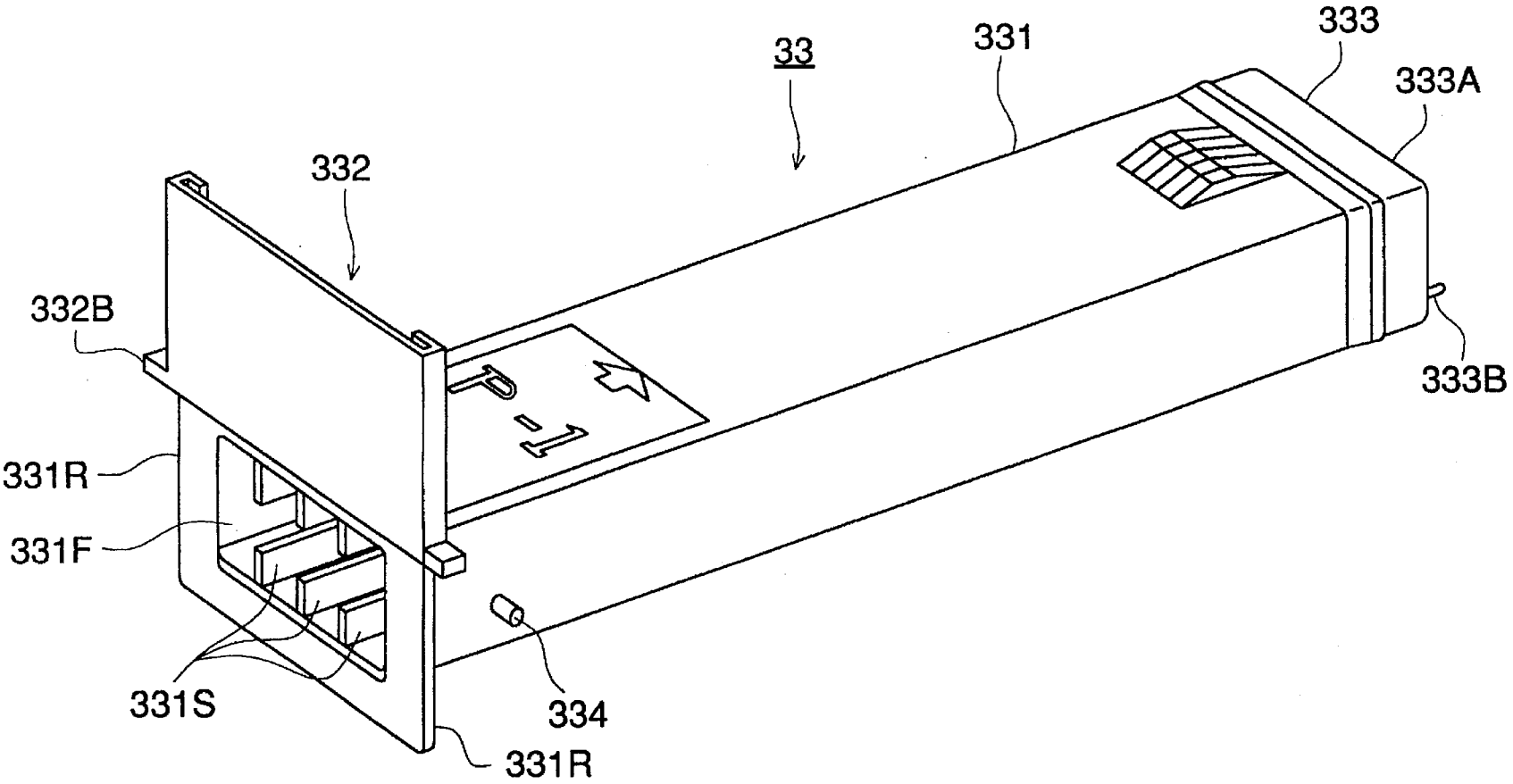
FIG. 7 is a perspective view of a solid processing agent accommodation container.

FIGS. 6 and 7 are views showing the accommodating container (cartridge) 33 for accommodating the tablet type solid processing agent J. FIG. 6(A) is a plan view of the accommodating container 33 on the condition that it is charged with the solid processing agent J. FIG. 6(B) is a side view of the accommodating container 33. FIG. 7 is a perspective view of the accommodating container 33 with its open/close cover 332 opened.

The accommodating container 33 includes: a square hollow container main body 331 for storing a plurality of the solid processing agents J, the container main body 331 having on its front side a discharge opening 331F through which the solid processing agent j can be discharged; a open/close cover 332 capable of opening or closing the discharging opening 331F wherein the open/close cover 332 moves upward or downward by sliding on rail sections 331R provided on both sides of a flange section on edges of the discharging opening 331F of the container main body 331; and a fixed cover 333 for closing the opening 331G on the rear side of the container main body 331.

Three sets of partition walls 331S are integrally formed inside the container 331 so that the inside of the container 331 is divided into four chambers and compartments 331A, 331B, 331C, 331D are constructed. In each compartment, each outer circumference of the solid processing agents is externally contacted and approximately 10 tablets of solid processing agents J are accommodated under the serially-aligned condition. Accordingly, 10 tablets of solid processing agents J1A to J10A are accommodated in the first compartment 331A, and 10 tablets of solid processing agent J1B to J10B are accommodated in the second compartment 331B. In the same manner, the solid processing agents J1C to J10C and J1D to J10D are respectively accommodated in the compartments.

Figure 8:
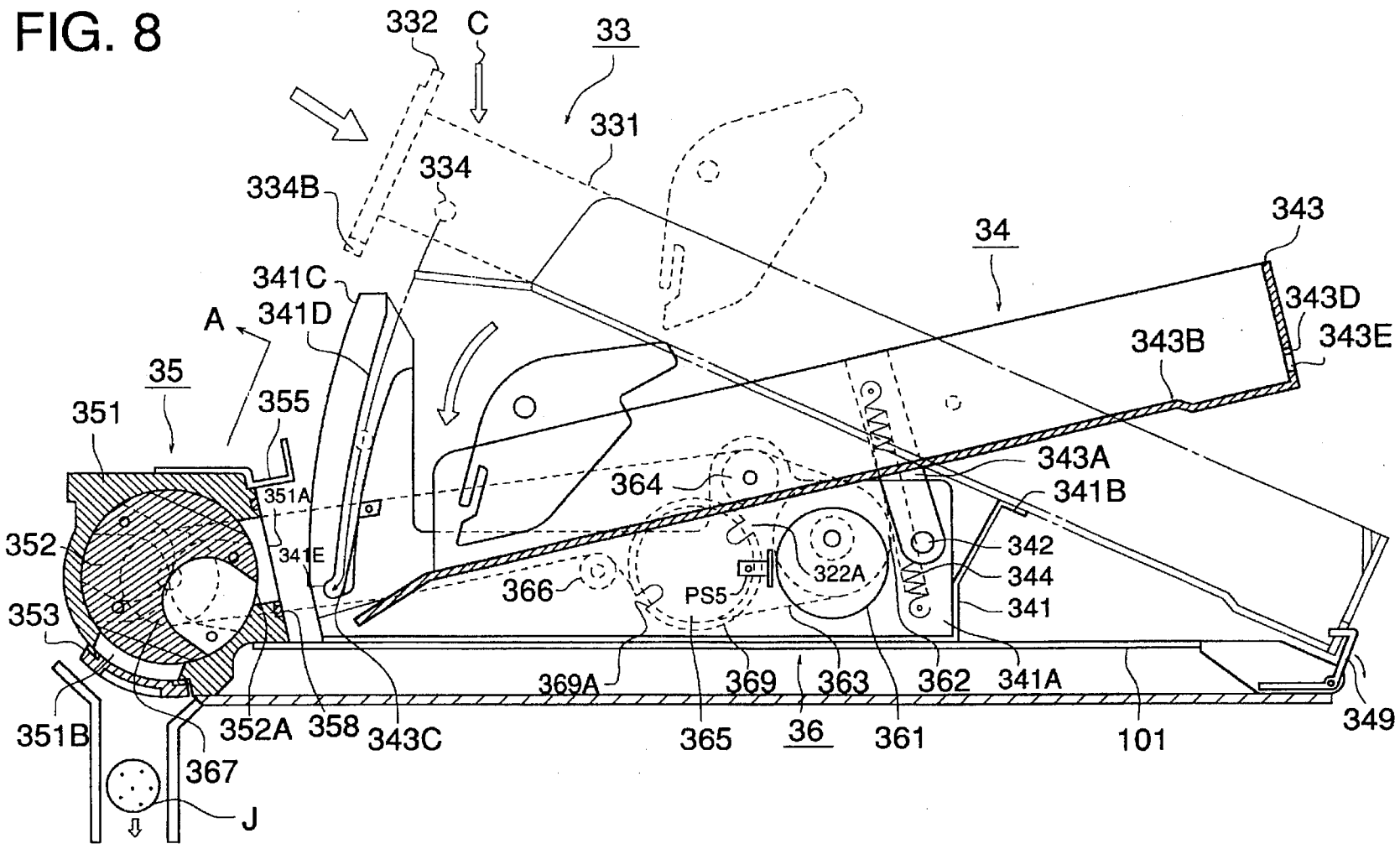
FIG. 8 is a sectional view showing a solid processing agent replenishing apparatus.

FIG. 8 is a sectional side view of an accommodation container mounting means 34 and a solid processing agent replenishing apparatus composed of supply means 35 and drive means 36.

A fixed frame 341 of the accommodation container mounting means 34, a housing member 351 integrated with the fixed frame 341 and drive means 36 are fixed on an upper portion of a base plate 103.

Support shafts 342 protrude from both side plates 341A of the fixed frame 341 on the right end shown in the drawing. The support shafts 342 are engaged in holes disposed at the lower end of an arm 343A fixed on both sides of a container holding member 343 for holding the accommodating container 35, so that the container holding member 343 can be oscillated around the support shaft 342. The side plate 341A and arm 343A are respectively provided with a fixing pin, and a tension spring 344 is attached to the fixing pin. Therefore, as illustrated by the one-dot-dash line in the drawing, the container holding member 343 is rotated clockwise being pushed by the spring, and the bottom portion of the container holding member 343 comes into contact with a stopper portion 341B protruding to a right upper portion of the fixed frame 341. Then the movement of the container holding member 343 is stopped, and the container holding member 343 is maintained in a condition before the accommodating container 33 is mounted, that is, the container holding member 343 is maintained at the first position.

At a position close to the left end of the side plate 341A of the fixed frame 341, there is provided a rising portion 341C, in which a circular guide groove 341D is formed, wherein the circular guide groove 341D is provided around the support shaft 342. The accommodating container 33 is charged to the container holding member 343 of the accommodating container charging means 34, and the accommodating container holding member 343 is oscillated around the support shaft 342, so that the left end portion of the container holding member 343 is pushed downward in the direction C shown in the drawing. Then the guide pin 332 of the accommodating container 33 advances in the guide groove 341D while the guide pin 332 is being pushed downward by a pushing member 343C of the accommodating container charging means 34. An L-shaped groove portion 341E is formed in the lowermost portion of the guide groove 341D. When the pin 332B enters this L-shaped groove 341E being pushed by the pushing member 343C, the front of the accommodating container 33 closely comes into contact with an entrance portion 351A of the supply means 35 (the second position). When the accommodating container 33 is charged to the container holding member 343, a surface of the container holding member 343 comes into contact with a back surface 333A of the cap member 333 of the accommodating container 33. On the surface of the container holding member 343, there is provided a discrimination receiving section which engages with the discriminating section 333B disposed on the back surface 333A of the cap member 333. Consequently, according to the present invention, in the case where a wrong accommodating container is charged, the accommodating container 33 is not moved from the first position to the second position, wherein the first position is a position of the container holding member 343 before the accommodating container is charged, and the second position is the a position of the container holding member 343 at the time of supplying the processing agent. In other words, only when the discriminating section coincides with the discriminating receiving section, the accommodating container 33 is moved from the first to the second position.

The supply means 35 is disposed in the housing member 351 in such a manner that the supply means 35 can be rotated on an inner circumferential surface of the housing member 351. The supply means 35 includes a rotatable solid processing agent conveying member (rotor) 352, and a shutter section 353 for opening and closing the outlet portion 351B, wherein the solid processing agent conveying member (rotor) 352 has a pocket portion 352A by which a predetermined amount of solid processing agent J is received from the inlet portion 351A and moved to the outlet portion 351B.

A frame-shaped resilient packing 358 is embedded in the periphery of the opening on the end surface of the inlet portion 351A of the housing member 351. When the discharge opening of the accommodating container 33 is closely contacted with the inlet portion 351A, the atmosphere can be shut off by the frame-shaped resilient packing 358, so that moisture-proofing effect can be provided.

At an upper position of the inlet portion of the housing member 351 of the supply means 35, there is provided an opening and closing regulating member 355 for regulating the opening and closing operation of the sliding cover. When the accommodating container 33 provided in the accommodating container charging means 34 is pushed downward from the initial position (shown by a one-dotted chain line) in the direction of arrow C in the drawing, the accommodating container 33 reaches the intermediate position (shown by a one-dotted chain line). Then the descending motion of a protrusion 334B of the sliding cover 334 is stopped by the opening and closing regulating member 355(355B). When the accommodating container 33 is further oscillated, the opening of the outlet opening member 332 of the accommodating container 33 is gradually opened since the sliding cover 334 can not further go downward. When the downward motion of the accommodating container 33 is stopped at a predetermined position, the opening is completely opened, and the solid processing agent tablet J in the first row in the accommodating container 33 is sent to the supply means 35. This complete opening condition is shown by a solid line in the drawing.

When all solid processing agent tablets J in the accommodating container 33 have been successively consumed, a remainder detection signal is generated, and the accommodating container 33 is replaced in accordance with the signal. When the accommodating container 33 is withdrawn backward, the accommodating container 33 and container holding member 343 are rotated clockwise, so that the left end portion is raised. In this ascending process, the opening and closing regulating member 355A stops the motion of the sliding cover 334, and only the main body composed of the container main body 331 and the cap member 333 is raised, so that the opening portion is closed by the sliding cover 334. Further, in the latter half process in which the accommodating container 33 is raised, the apparatus is returned to the initial condition, which is an upper dead point, while the opening portion is in a closed condition. Therefore, powder of the processing agent in the container can be prevented from being scattered. Even when the container is removed for maintenance while the processing agent remains in the container, the processing agent can not be dispersed since the opening portion is in a closed condition.

Figure 9:
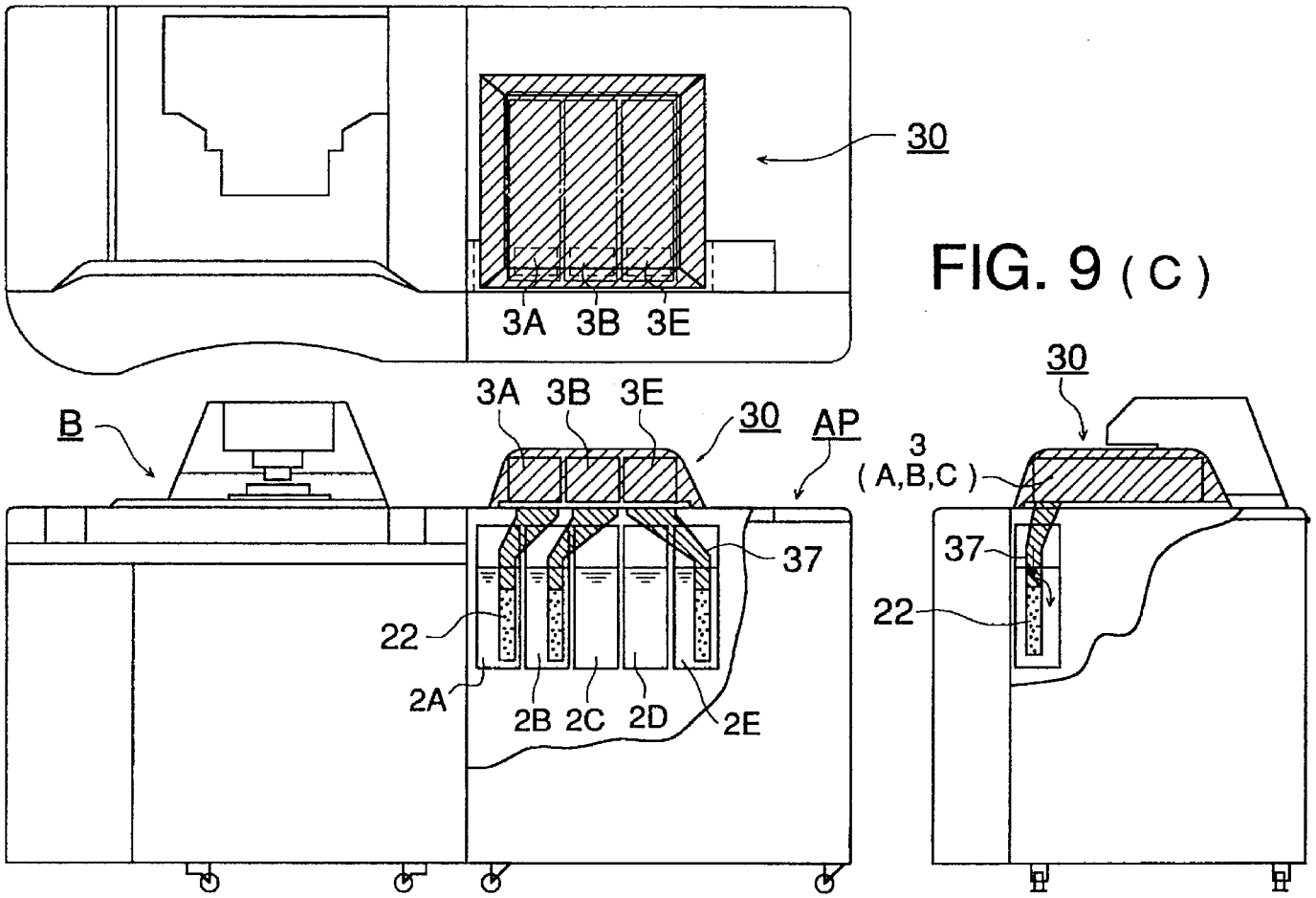
FIGS. 9(A) is a plan view, 9(B) is a front view and 9(C) is a side view, each showing respectively a photographic material processing apparatus on which a solid processing agent replenishing apparatus is mounted.

FIG. 9(A) is a plane view of a silver halide photographic material equipped with the solid processing agent replenishing apparatus 30, FIG. 9(B) is a front view which is partially cut out, and FIG. 9(C) is a side view which is partially cut out. In these figures, a section applied with slanted lines is the solid processing agent replenishing apparatus 30 which is additionally mounted on the conventional automatic processing apparatus AP.

FIG. 10(A) is a plane view of the conventional dissolving tank on which the solid processing agent replenishing apparatus 30 of the present invention is additionally mounted, and FIG. 10(B) is its sectional view.

As shown in FIG. 10, since a filter means 22, a heater 25, a temperature sensor 26, a level sensor (a float switch) 27, a thermostat 26A, a processing solution replenishing pipe 28, a cooling pipe 29A, 29B are arranged in high arrangement density so that there are no room to supply the solid processing agent J discharged from the newly installed solid processing agent replenishing apparatus 30.

Figure 11:
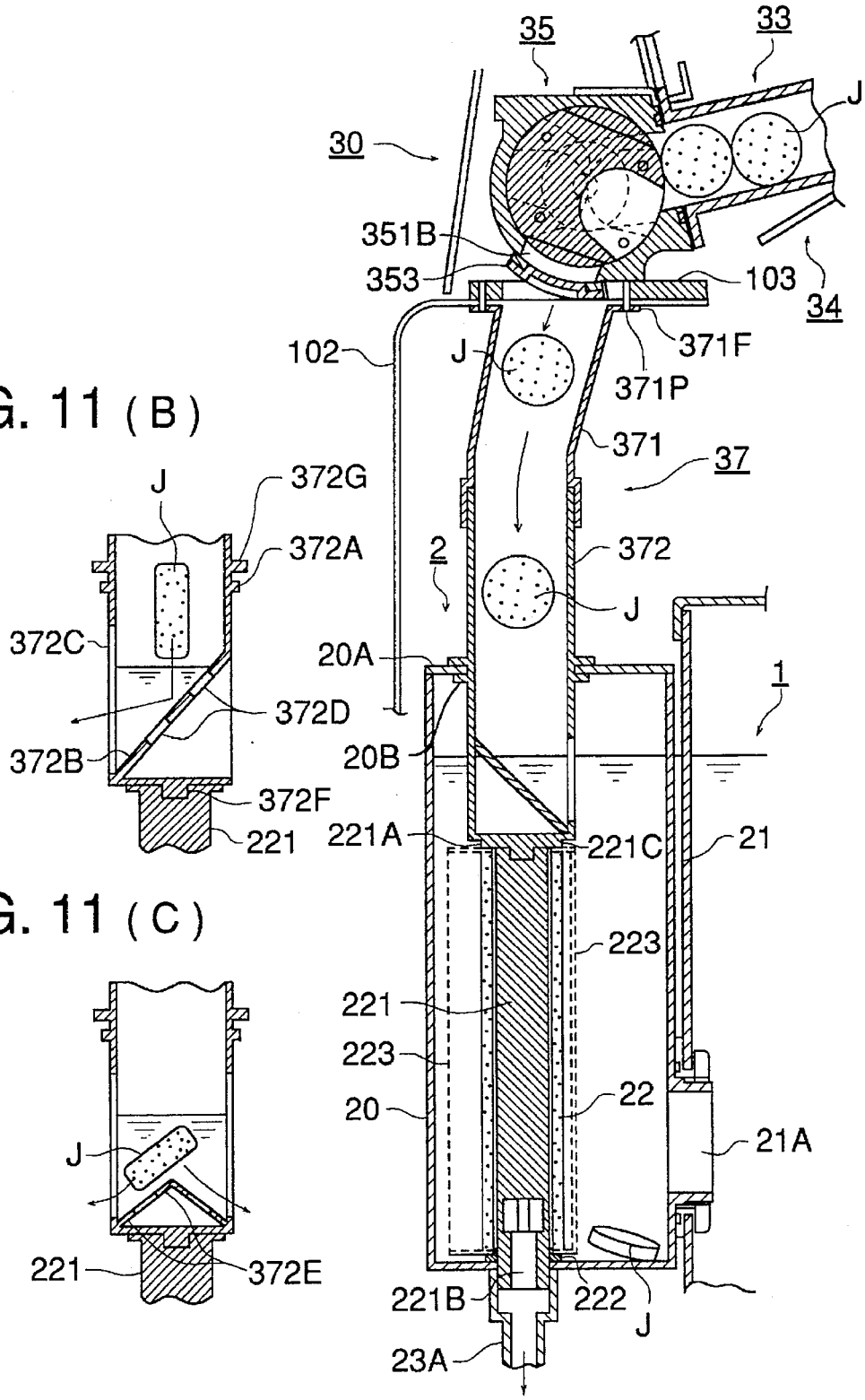
FIGS. 11(A) through 11(C) are sectional views showing a connecting means and the dissolving tank.
Figure 12:
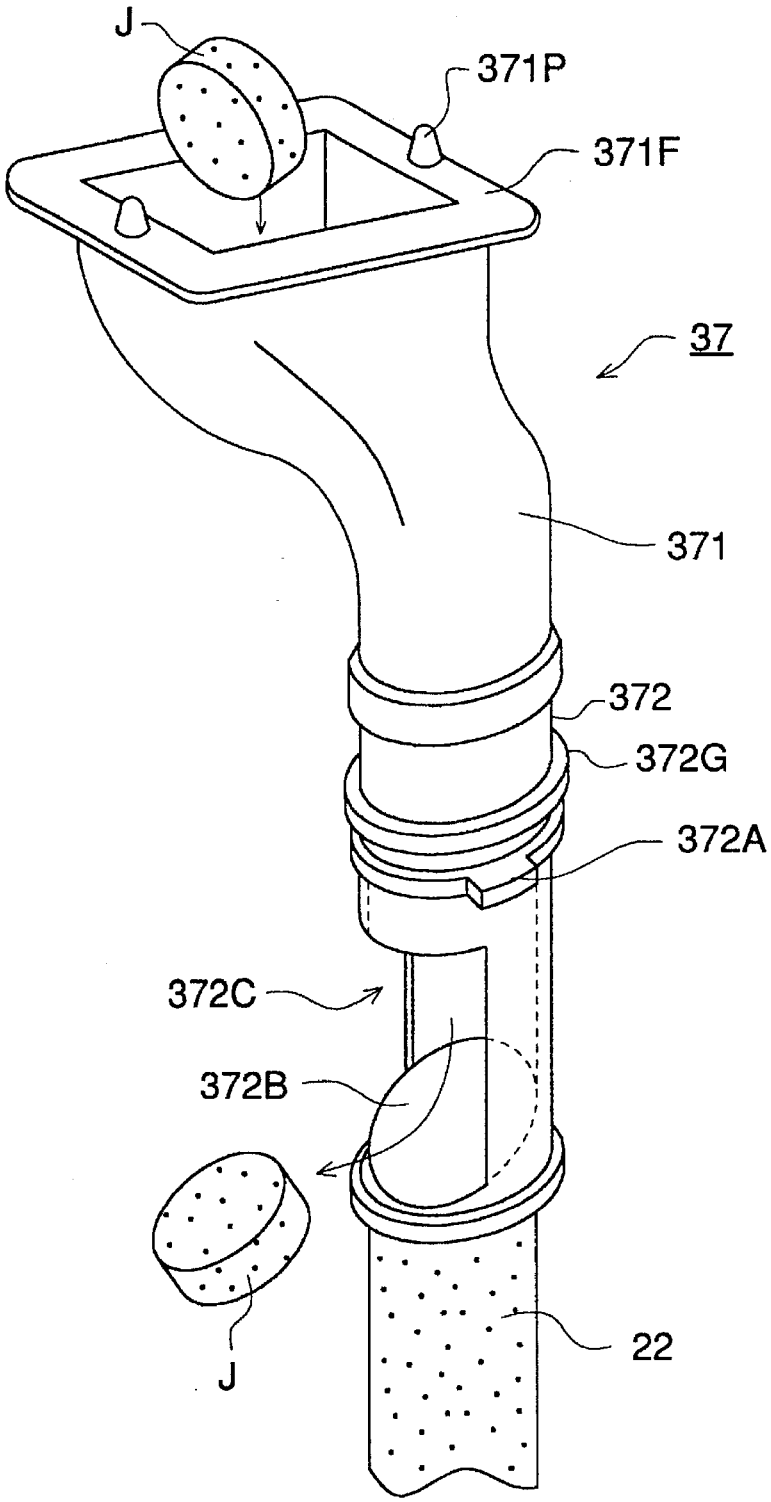
FIG. 12 is a perspective view showing the connecting means.

FIG. 11(A) is a sectional view showing a guiding means 37 (a guide passage construction member) for connecting the conventional auxiliary tank 2 (a dissolving tank) and the solid processing agent replenishing apparatus 30 of the present invention to be additionally mounted. FIG. 11(B) is a partial sectional view of a connecting cylinder 372 of the above guiding means 37. FIG. 11(C) is a partial sectional view of another example of the connecting cylinder 372. FIG. 12 is a perspective view showing a dropping cylinder 371 of the guiding means 37, the connecting cylinder 372 and the filter means 22. FIG. 13 indicates the connecting cylinder, FIG. 13(A) is a front view, FIG. 13(B) is a A—A sectional view, FIG. 13(C) is a plane view, FIG. 13(D) is a bottom view, and FIG. 13(E) is a plan view showing a portion of the cover 20A which locates in the vicinity of the opening section.

The guiding means is composed of the dropping cylinder 371 and the connecting cylinder 372. A flange section 371F on the upper portion of the dropping cylinder 371 is attached in close proximity to the upper cover 102 and is determined its position by two pieces of pins 371P. The open section of the flange section 371F of the dropping cylinder 371 forms a through hole with each opening section of the upper cover 102 and the base plate and faces the outlet section 351B of the supplying means 35 of the solid processing agent replenishing apparatus 30. Accordingly, when a shutter member 353 is opened, above opening sections receive the solid processing agent J from the outlet section 351B.

A lower end section of the dropping cylinder 371 is fitted in the upper section of the connecting cylinder 372. The lower end section of the dropping cylinder 371 is detachable and rotatable freely relative to the upper section of the connecting cylinder 372. A bayonet claw section 372A protrudes on two positions on the outer wall of the middle portion of the connecting cylinder 372 and comes in engagement with a bayonet mount section 20B provided in close proximity to the opening section of the cover 20A of the dissolving tank 2. When the dropping cylinder is inserted in the opening section of the cover 20A and is rotated by approximately 90 degrees, the bayonet claw section 372A is fixed to the bayonet mount section 20B. The reference No. 372B is a flange section fixed on an upper portion of the bayonet claw section 372A. When the bayonet claw section 372A is fixed to the bayonet mount section 20B, an air gap section of the bayonet mount section 20B is sheltered.

A slanted surface 372B is formed in the vicinity of the bottom portion of the connecting cylinder 372 so that the solid processing agent J dropped from the dropping cylinder 371 is changed its direction and discharged toward the opening section 372 provided on the side wall of the connecting cylinder 372. The slanted wall is provided with a through hole 372D so that the processing solution is circulated very well. In addition to the through hole 372 illustrated in FIG. 11(C), additional through holes 372 may be provided as far as the strength of the construction permits. Two slanted surfaces 372E whose center section is shaped in the form of convex are formed on the bottom section of the connecting cylinder as shown in FIG. 11(C). The dropped solid processing agent is discharged either the right side or the left side of the convex-shaped center section. It may be preferable that an entire portion or a part of the slanted surface 372B having the through hole 372D is immersed under the surface of the processing solution. It may be more preferable that the lower portion of the slanted surface 372B positioned lower from the point located one-third of the entire length of the slanted surface from its top edge is immersed in the processing solution. With this structure, the foaming on the surface of the processing solution caused by the powder generated on the slanted surface 372 may be avoided.

A protruding section 372F protrudes on the center of the bottom section of the connecting cylinder 372 and is fitted with an upper hole 221A of a metal core member 221 of a filter means 22. The connecting cylinder 372 and the metal core member 221 may be integrated into one body by the technique of gluing, thermal melting, coaking, or compulsive fitting. It may be more preferable to form the both members in a single unit by a integral structure formation process. By forming it in the single body with the above technique, it becomes possible to hold the connecting cylinder 372 without touching the processing solution and to easily dismount it. The hollow cylinder-shaped filter means 22 is provided on the outer periphery of the metal core member 221 and spaced with a distance from the metal core member 221. A filter pressing member 222 is inserted in the vicinity of the bottom section of the metal core member 221 and supports the filter means 22. The bottom section of the metal core member 221 is fitted with a hole on the bottom section of the tank body 20 of the dissolving tank 2 and is connected with the circulating pipe 23A. The processing solution in the dissolving tank 2 dissolves the dropped solid processing agent J, passes through the filter means 22, passes over the lower holes 221B through the clearance in the metal core member 221, is discharged into the circulating pipe 23A, and is fed to the processing tank 1 by the circulating pump 24.

In FIG. 10(B), on the outside further the periphery of the filter means 22 is provided a partition plate 223 on which a plurality of holes are perforated, and the partition plate 223 is fixed to an internal wall of the dissolving tank. The partition plate 223 works in such a manner that the solid processing agent discharged from the side of the connecting cylinder 372 is prevented from contacting with the filter means 22.

Figure 14:
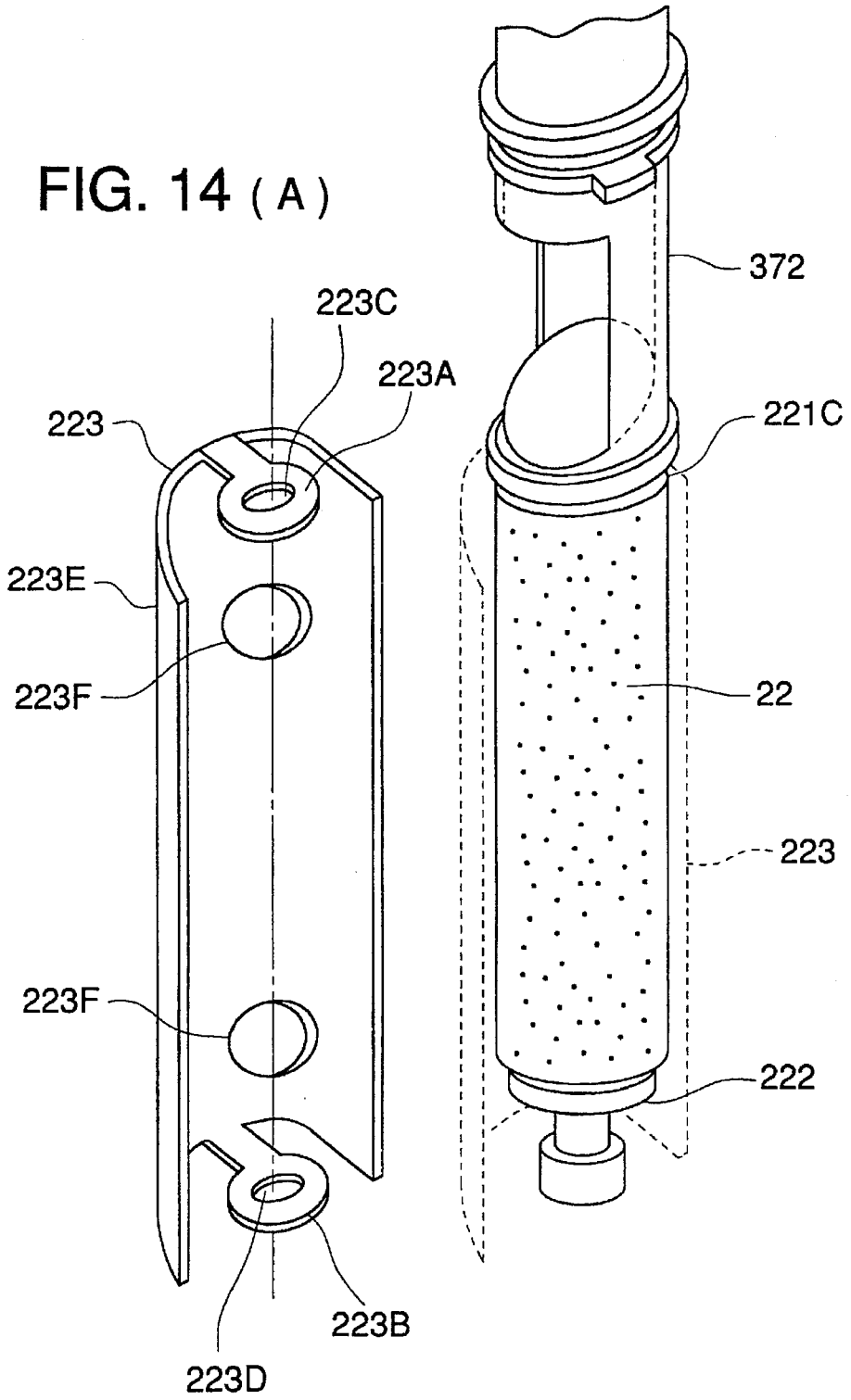
FIG. 14(A) and 14(B) are perspective views showing a partition plate and a filter.

FIG. 14(A) is a perspective view showing the partition plate 223, and FIG. 14(B) is a perspective view showing the condition that the partition plate 223 is fixed on a portion which corresponds to the lower portion of the connecting cylinder 372 and to the upper portion of the filer 22.

Bent sections 223A, 223B are provided on the upper and lower portions of the partition plate 223 and are provided with through holes 223C, 223D respectively. The upper bent section 223A with the through hole 223C is held between the filter means 22 and the flange section 221C located upper the metal core member 221, and on the other hand, the lower bent section 223B with the through hole 223D is held between the filter means 22 and the filter pressing member 222.

A side plate 223E of the partition plate 223 is curved substantially in the form of the character "U". The side plate 223E is inserted into protruding sections 20A, 20B in the dissolving tank 20 and fixed by its elasticity to the protruding sections 20A, 20B. The outer diameter of the curved surface of the side plate 223E is larger than the outer diameter of the connecting cylinder 372 and is formed so as to have a gap between it and the outer periphery of the filter means 22. Further, a plurality of holes 223F are perforated on the side plate 223E of the partition plate 223. A solid processing agent J and replenishing water W are dropped in the dissolving tank respectively, and are dissolved in the processing solution. The solid processing agent J and replenishing water W mixed with the processing solution pass through the plurality of holes 223*f* of the side plate 223E and the filter means 22, and then are supplied to the processing tank 1.

In the case that the solid processing agent supplying apparatus of the present invention is additionally mounted on a conventional automatic processing apparatus AP, a conventional processing solution supplying apparatus is no longer needed. However, a processing solution replenishing tank and a processing solution supplying pipe may be used as the replenishing water tanks 41A, 41B and the replenishing water supplying pipe shown in FIG. 4.

Figure 16:
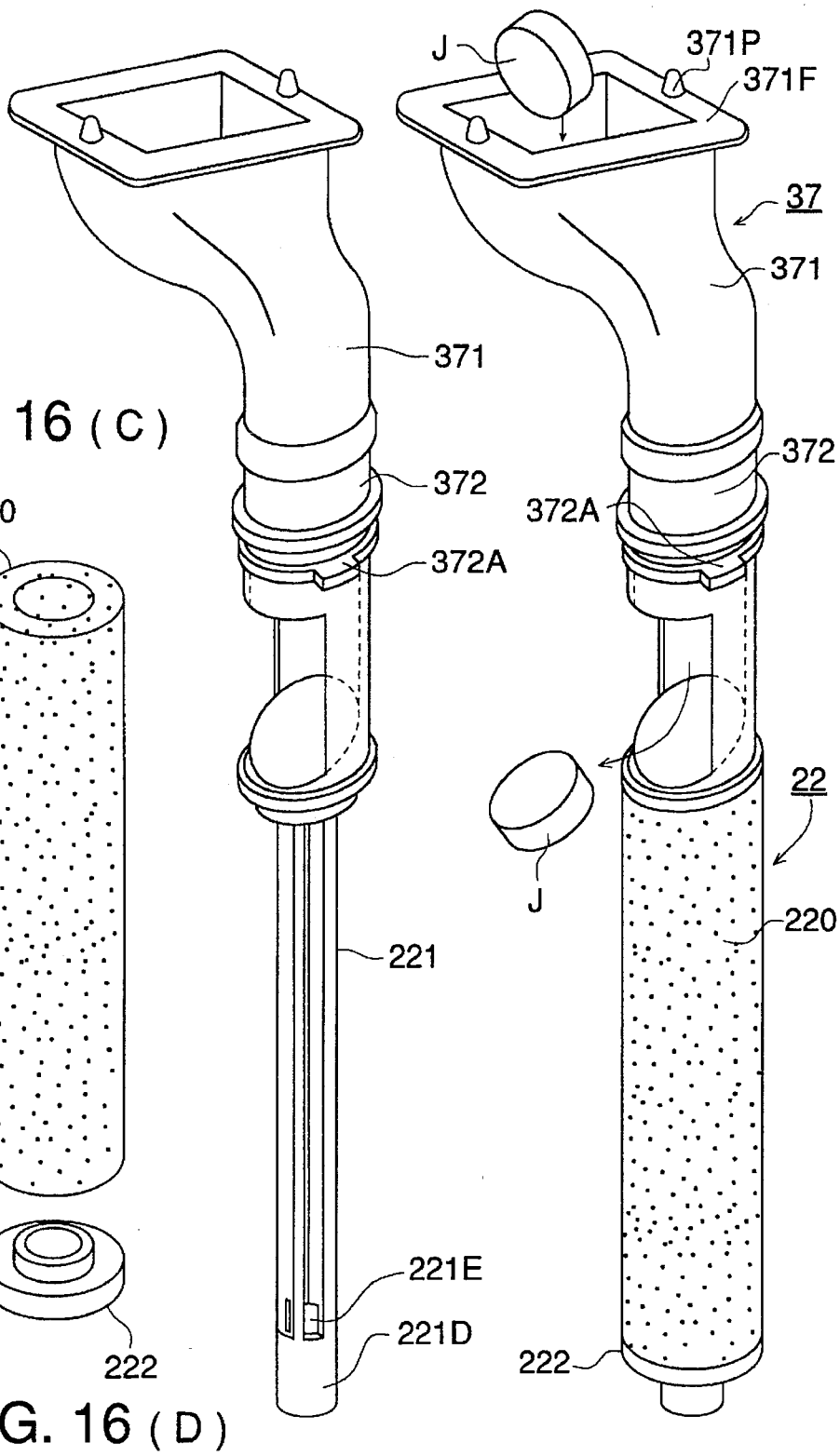
FIGS. 16(A) and 16(B) are perspective views showing a solid processing agent supplying section in which the guiding means and the filter means are integrated.
FIGS. 16(C) and 16(D) are exploded perspective views illustrating the disassembled filter means.

FIG. 15(A) is a sectional view showing the solid processing agent replenishing apparatus, the guiding means 37 composed of a passage-constructing member for guiding a solid processing agent dropped from the solid processing agent replenishing apparatus, and the filter means 22. FIG. 15(B) is a A—A sectional view of the filter means 22. FIG. 15(C) is a B—B sectional view of the filter means. FIG. 16(A) is a perspective view of the solid processing agent supplying section showing an integral construction of the guiding means 37 of the present invention and the filter means 22. FIGS. 16(B) through 16(D) are perspective views showing the disassembled solid processing agent supplying sections respectively. FIG. 16(B) is a perspective view of a supplying member in which the dropping cylinder 371, the connecting cylinder 372, and the metal core member (fixing shaft) are integrated in a single unit. FIG. 16(C) is a perspective view of the filter means 220. FIG. 16(D) is a perspective view of the filter-pressing member 222. Incidentally, Incidentally, in FIGS. 15 and 16, each portion which has the same function of the corresponding portion in FIG. 11 and 12 in which the above embodiment is explained is provided with the same reference No. of the above embodiment. Hereinafter, the explanation is made for the different portions from the above embodiment.

In these drawings, the connecting cylinder 372 and the metal core member 221 (fixing shaft) are subjected to the integral structure formation process or the gluing fixing so that the integrated solid processing agent supplying member is formed. The position of the integral solid processing agent supplying member is determined and fixed in such a manner that the hollow shaft end portion 221D on the lower end of the metal core member 221 is inserted in a hole on a bottom portion of the dissolving tank and then the bayonet claw section 372A provided on the connecting cylinder 372 is engaged with the bayonet mount section 20B provided on the cover 20A of the dissolving tank. Further, the dropping cylinder 371 is rotatably supported on the upper portion of the connecting cylinder 372. Incidentally, the dropping cylinder 371 may be rotatably integrated with the connecting cylinder 372, or the both cylinder may be integrally fixed with each other. Alternately, the dropping cylinder 371 may be detachably mounted on the connecting cylinder 372 whose position is fixed.

A plurality of small openings 221E are provided on the upper portion of the hollow shaft end portion 221D of the metal core member 221. A solid processing agent J dropped from the solid processing agent replenishing apparatus 30 passes through each cylinder of the dropping cylinder 371 and the connecting cylinder 372, collides with the slanted surface 372B, slides downwardly on the slanted surface 372B, and is discharged through the opening portion 372C to the outside of the cylinder. Then the solid processing agent J submerges in the processing solution in the dissolving tank 2 and is dissolved in the processing solution. The processing solution proceeds from the upper portion of the partition plate 223 into the separated region, passes through porous filter member 220, further proceeds from the plurality of small openings 221F of the metal core member 221 to the inside of the metal core member 221, lowers in the inside of the metal core member 221, is discharged through the hollow shaft end portion 221D to the circulating pump 23A, and is fed to the processing tank 1 by the circulating pump 24.

When the filter member 220 is replaced with another one or the cleaning and the inspection are conducted for the inside of the solid processing agent-passing passage and the dissolving tank 2, such the maintenance works can be easily conducted by lifting the above integrated solid processing supplying member upwardly.

Figure 17:
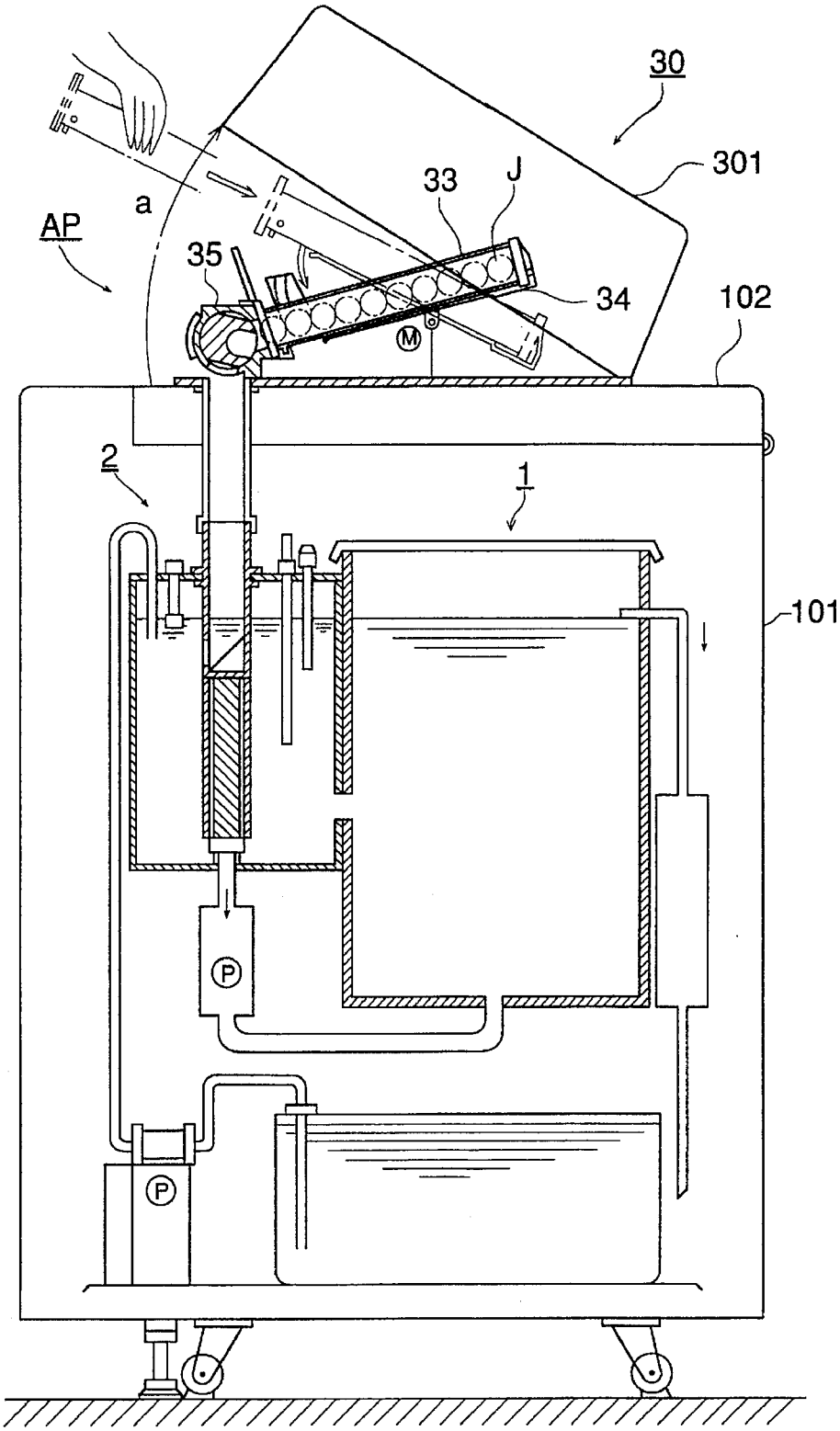
FIG. 17 is a sectional view of the automatic processing apparatus showing the condition that the solid processing agent accommodation container is mounted or dismounted.

FIG. 17 is a sectional view of the automatic processing apparatus AP showing the condition that the accommodation container storing the solid processing agent J is mounted on or dismounted from the apparatus AP.

When the upper cover 102 is lifted up in the direction "a" as shown in FIG. 15, the upper side and the front side which corresponds to the operator side and to the left side in FIG. 15 are opened for an operator. In such the opened condition, the solid processing agent replenishing apparatus 30 is exposed for an operator so that the solid processing agent accommodation container 33 is mounted or replaced with a new one, whereby the solid processing agents J are replenished to the apparatus AP. Further, in such the opened condition, an inspection for the solid processing agent replenishing apparatus 30 can be conducted.

Figure 18:
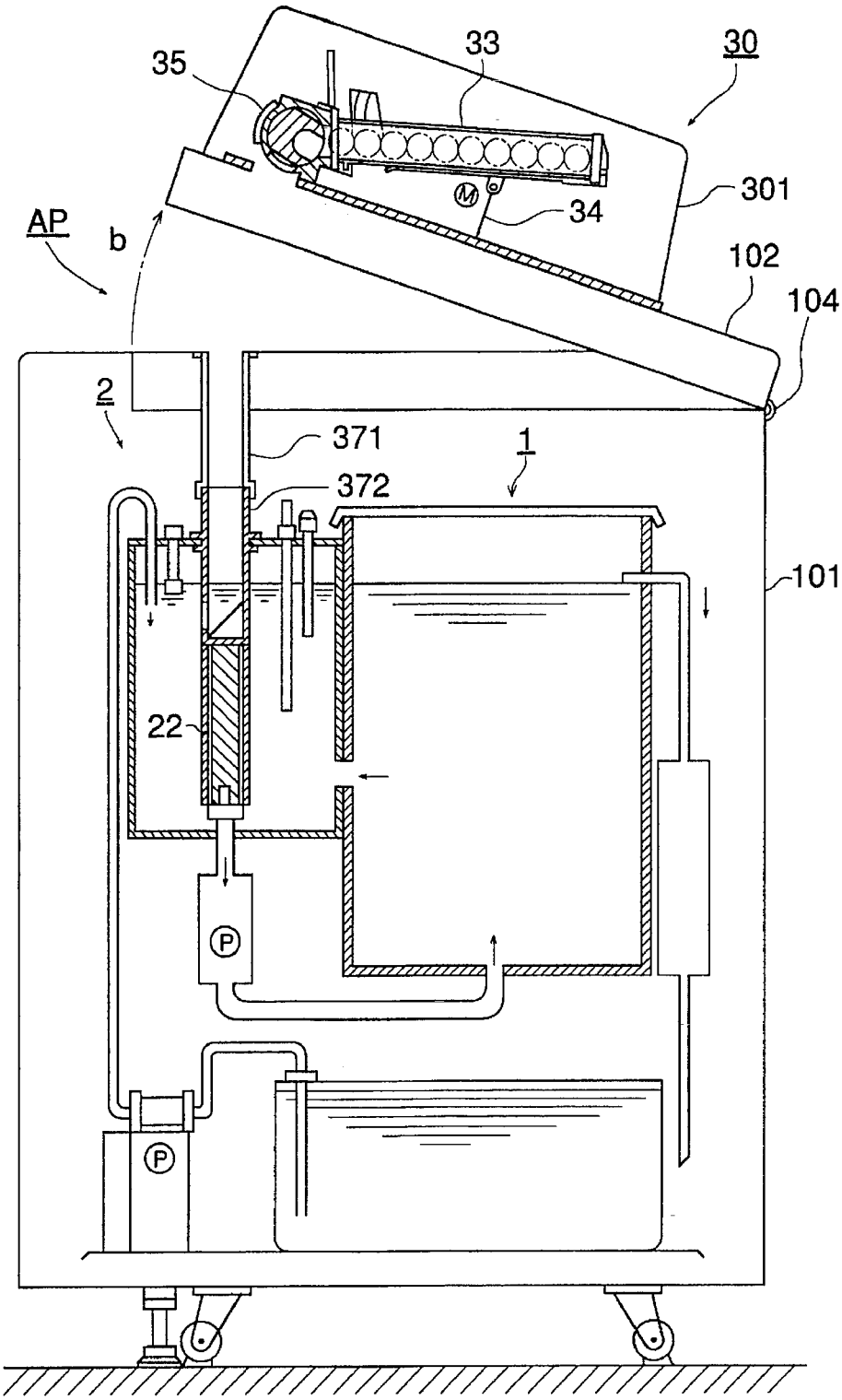
FIG. 18 is a sectional view of the automatic processing apparatus and the solid processing agent replenishing apparatus showing the condition that an upper portion of the automatic processing apparatus is opened.

FIG. 18 a sectional view of the automatic processing apparatus AP showing the condition that the upper cover 102 on which the accommodation container storing the solid processing agent J is mounted is opened.

When the upper cover is lifted around a hinge 102 working as a pivot shaft for opening or closing in the direction "b" shown with one doted lines in FIG. 15, the upper side and the front side which corresponds to the operator side and to the left side in FIG. 16 are opened for an operator. In such the opened condition, the filter means 22 can be replaced, and an inspection and a maintenance work can be conducted for the processing tank 1 and the dissolving tank 2.

In the above embodiment, the solid processing agent replenishing apparatus 30 is mounted on the automatic processing apparatus Ap for a photographic printing paper. However, the present invention is not limited to this embodiment. For example, the solid processing agent replenishing apparatus 30 and the guiding means of the present invention can be additionally easily mounted on the automatic processing apparatus AN for the exposed photographic negative film.

Further, in the above embodiment, the tablet type solid processing agent J is replenished. However, the solid processing agent replenishing apparatus 30 and the guiding means of the present invention can be applied to an apparatus in which a granular solid processing agent is supplied by a predetermined amount for each time.

Still further, to additionally provide a shutter for shielding a moisture of the processing solution and a means for preventing solution-splushing onto the dropping cylinder 371 or the connecting cylinder 371 is easily conducted by an ordinary designing method.

In the above embodiment, the replenishing apparatus replenishes the tablet type solid processing agent. However the replenishing apparatus of the present invention is not limited to this embodiment. The replenishing apparatus of the present invention may be applicable to a replenishing apparatus for replenishing a granular, powdery, or pill-shaped solid processing agent.

Figure 19:
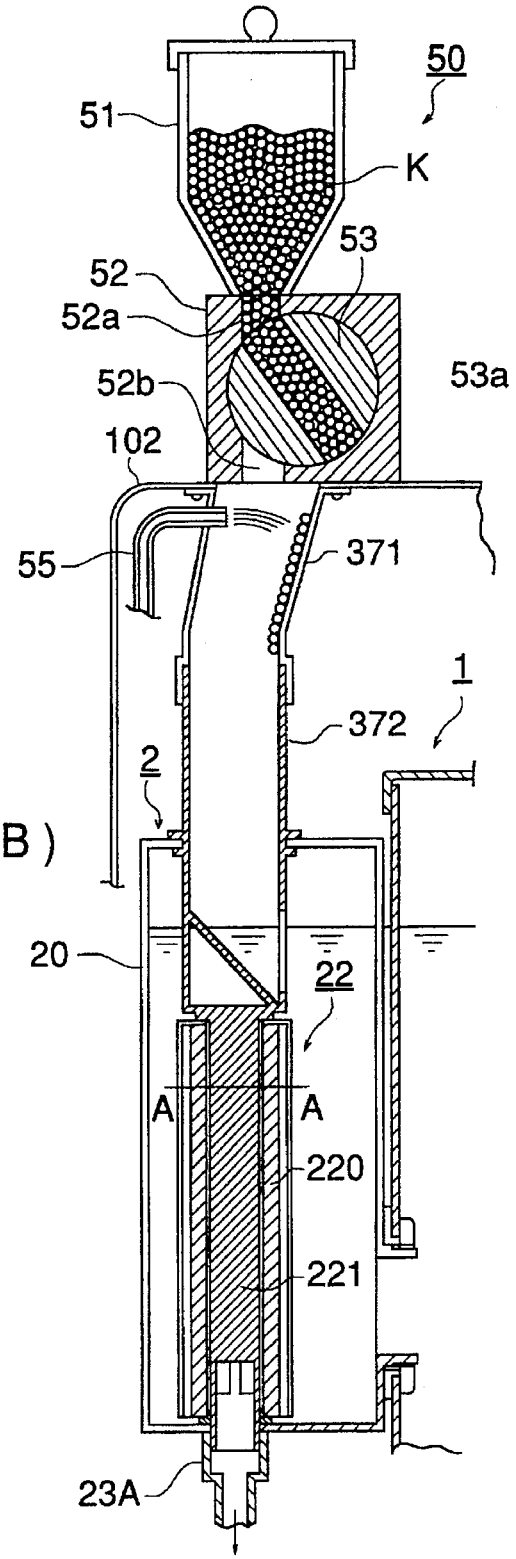
FIG. 19(A) is a sectional view showing a replenishing apparatus for replenishing granular, powdered, or pill-shaped agents.
FIGS. 19(B) is a sectional plan view of them.
Figure 19:
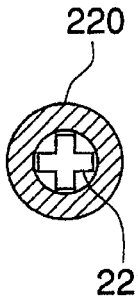

FIG. 19(A) is a sectional view of a replenishing apparatus for replenishing a granular, powdery, or pill-shaped solid processing agent (powdery chemical) K. FIG. 19(B) is a sectional view of the filter means.

The replenishing apparatus 50 comprises a hopper 51 for storing the granular, powdery, or pill-shaped solid processing agent (powdery chemical) K, a housing member 52 which is connected with the hopper 51 and is fixed on the upper cover 102, a rotary type drum 53 (rotor) which is connected with a driving source mentioned later. A feeding port 52*a* on an upper portion of the housing member 52 is connected with a discharging port on a lower portion of the hopper 51. A discharging port 52*b* of a lower portion of the housing member 52 is connected with the upper opening of the dropping cylinder 371. The rotary type drum 53 is provided with a metering hole 53*a* to meter the granular, powdery, or pill-shaped solid processing agent (powdery chemical) K by a predetermined amount. Reference No. 55 is a water-feeding nozzle connected to the replenishing water tank 41. The solid processing agent K deposited on a slanted surface of the dropping cylinder 371 is washed away with the use of the water-feeding nozzle.

Figure 20:
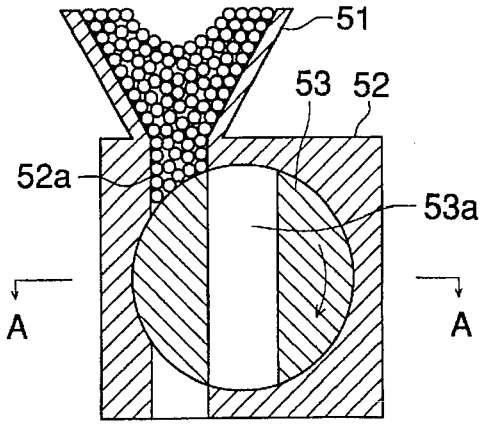
FIGS. 20(*a*) through 20(*d*) are sectional views showing replenishing processes for solid processing agent K.
Figure 20:
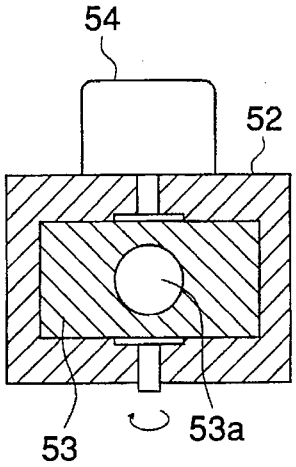
Figure 20:
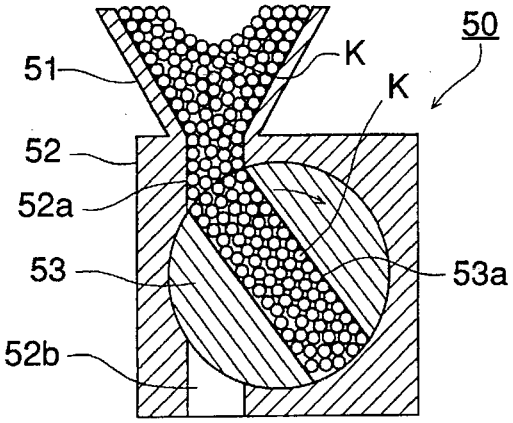
Figure 20:
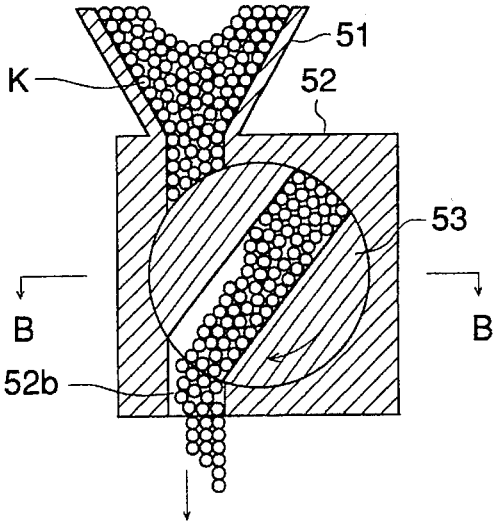

FIGS. 20(*a*), 20(*b*) and 20(C) show the feeding process of the solid processing agent K. FIG. 20(*d*) is a sectional view of FIG. 20(*a*).

FIG. 20(*a*) shows a stop condition before replenishing the solid processing agent K. On this stop condition, the metering hole 53*a* of the rotary type drum 53 is deviated from the feeding port 52*a* of the housing member 52 so that the solid processing agent k in the hopper 51 does not drop. When the rotary type drum 53 locates a position shown in FIG. 20(*b*) as the rotary type drum 53 is rotated by the driving source 54, the feeding port 52*a* conforms with the metering hole 53*a* so that the predetermined amount of the solid processing agent k is charged from the hopper 51 into the metering hole 53*a*. When the rotary type drum 53 locates a position shown in FIG. 20(*c*) as the rotary type drum 53 is further rotated, the predetermined amount of the solid processing agent K charged in the metering hole 53*a* drops from the discharging port 52*b* and is supplied to the dropping cylinder 371. Further, the solid processing agent K is fed through the connecting cylinder 372 to the processing solution in the vicinity of the filter means 22. In the solid processing agent replenishing apparatus 50 using the solid processing agent k, the solid processing agent supplying section of the present invention in which the guiding means 37 and the filter means are integrated can be applied.

As discussed above, when the solid processing agent replenishing apparatus 30 of the present invention is mounted as a unit on the upper cover 102 of the conventional automatic processing apparatus AP (AN) and the guiding means 37 is set on the upper portion of the filter, the solid processing agent J can be easily dropped into the dissolving tank. With such the arrangement, in the location on which the conventional automatic processing apparatus is provided, an additional space for mounting the solid processing agent replenishing apparatus 30 of the present invention is not needed, it may be not necessary to increase the amount of the processing solution, and troubles such as crystal precipitation may not take place. Further, with a short time work, the newly setting work for the solid processing agent replenishing apparatus 30 of the present invention and an additionally setting work for the guiding means can be conducted easily rapidly.

In particular, with the above arrangement of the present invention, the solid processing agent discharged from the newly mounted solid processing agent replenishing apparatus can be supplied to the small size dissolving tank in which a large number of machinery parts are arranged in high setting density.

What is claimed is:

1. A silver halide photographic material processing apparatus, comprising:

a tank in which a processing solution is stored, a filter provided in the tank at a position connectable with a pump; and a solid processing agent replenishing unit which comprises:

a container in which a solid processing agent is stored;

a supplying device for supplying the solid processing agent in the container to the tank; and a passage defining device for forming a guide passage in the tank in such an arrangement that the guide passage receives the solid processing agent from the supplying device, guides the solid processing agent to an upper portion above the filter, and feeds the solid processing agent from the upper portion into the processing solution, wherein the passage defining device has an upper end and a lower end, and the lower end is positioned above the filter.

2. The processing apparatus of claim 1, wherein the lower end of the passage defining device is connected with the filter.

3. The processing apparatus of claim 2, wherein:

the filter comprises a filter member and a fixing member to fix the filter member in the tank; and the lower end of the passage defining device is connected with an upper portion of the fixing member.

4. The processing apparatus of claim 3, wherein:

the fixing member includes a top cover mounted on the filter member and a fixing shaft; and the lower end of the passage defining device is connected with the top cover.

5. The processing apparatus of claim 4, wherein the lower end of the passage defining device is integrally connected with the top cover.

6. The processing apparatus of claim 3, wherein the filter member comprises a cylindrical filter.

7. The processing apparatus of claim 1, wherein a slanted surface and an opening are provided in the vicinity of the lower end of the passage defining device so that the solid processing agent is guided by the slanted surface so as to be discharged from the opening into the processing solution.

8. The processing apparatus of claim 1, wherein the filter is surrounded by a punched partition plate so that discharged solid processing agent is prevented from directly contacting with the filter.

9. The processing apparatus of claim 1, wherein the solid processing agent is a tablet type solid processing agent.

10. The processing apparatus of claim 1, wherein the solid processing agent replenishing unit is mounted on a top portion of the silver halide photographic material processing apparatus.

11. A silver halide photographic material processing apparatus, comprising:

a tank in which a processing solution is stored, a filter provided in the tank at a position connectable with a pump; and a solid processing agent replenishing unit which comprises:

a container in which a solid processing agent is stored;

a supplying device for supplying the solid processing agent in the container to the tank; and a passage defining device for forming a guide passage in the tank in such an arrangement that the guide passage receives the solid processing agent from the supplying device, guides the solid processing agent to an upper portion above the filter, and feeds the solid processing agent from the upper portion into the processing solution; and wherein the filter is surrounded by a punched partition plate so that discharged solid processing agent is prevented from directly contacting with the filter.

12. The processing apparatus of claim 11, wherein the solid processing agent is a tablet type solid processing agent.

13. The processing apparatus of claim 11, wherein the solid processing agent replenishing unit is mounted on a top portion of the silver halide photographic material processing apparatus.

14. A silver halide photographic material processing apparatus, comprising:

a tank in which a processing solution is stored, a filter provided in the tank at a position connectable with a pump; and a solid processing agent replenishing unit which comprises:

a container in which a tablet type solid processing agent is stored;

a supplying device for supplying the tablet type solid processing agent in the container to the tank; and a passage defining device for forming a guide passage in the tank in such an arrangement that the guide passage receives tablet type solid processing agent from the supplying device, guides the tablet type solid processing agent to an upper portion above the filter, and feeds the tablet type solid processing agent from the upper portion into the processing solution.

15. The processing apparatus of claim 14, wherein the solid processing agent replenishing unit is mounted on a top portion of the silver halide photographic material processing apparatus.

16. A silver halide photographic material processing apparatus, comprising:

a tank in which a processing solution is stored, a filter provided in the tank at a position connectable with a pump; and a solid processing agent replenishing unit which comprises:

a container in which a solid processing agent is stored;

a supplying device for supplying the solid processing agent in the container to the tank; and a passage defining device for forming a guide passage in the tank in such an arrangement that the guide passage receives the solid processing agent from the supplying device, guides the solid processing agent to an upper portion above the filter, and feeds the solid processing agent from the upper portion into the processing solution; and wherein the solid processing agent replenishing unit is mounted on a top portion of the silver halide photographic material processing apparatus.

* * * * *